US007471910B2

(12) United States Patent
Watanabe et al.

(10) Patent No.: US 7,471,910 B2
(45) Date of Patent: Dec. 30, 2008

(54) IMAGE FORMING APPARATUS AND GLOSS LEVEL CONTROL METHOD

(75) Inventors: Naoto Watanabe, Kashiwa (JP); Takako Hanada, Yokohama (JP); Kuniyasu Kimura, Toride (JP); Hiroto Nishihara, Toride (JP); Yukio Yokoyama, Saitama-ken (JP)

(73) Assignee: Canon Kabushiki Kaisha (JP)

( * ) Notice: Subject to any disclaimer, the term of this patent is extended or adjusted under 35 U.S.C. 154(b) by 189 days.

(21) Appl. No.: 11/468,120

(22) Filed: Aug. 29, 2006

(65) Prior Publication Data

US 2007/0071474 A1 Mar. 29, 2007

(30) Foreign Application Priority Data

Aug. 31, 2005 (JP) ..... 2005-252344

(51) Int. Cl.
*G03G 15/00* (2006.01)
*G03G 15/20* (2006.01)

(52) U.S. Cl. ..... 399/67; 347/156; 399/69; 399/81

(58) Field of Classification Search ..... 399/67, 399/68, 69, 320, 82, 81, 341; 219/216; 347/156; 358/540, 504, 406
See application file for complete search history.

(56) References Cited

U.S. PATENT DOCUMENTS

| | | | | |
|---|---|---|---|---|
| 5,852,462 | A * | 12/1998 | Lloyd et al. | 347/156 |
| 6,430,389 | B1 * | 8/2002 | Kimura | 399/81 |
| 2003/0031371 | A1 * | 2/2003 | Kato et al. | 382/239 |
| 2007/0140717 | A1 * | 6/2007 | Hayashi et al. | 399/69 |

FOREIGN PATENT DOCUMENTS

| | | |
|---|---|---|
| JP | 06-202520 A | 7/1994 |
| JP | 09-160315 A | 6/1997 |

OTHER PUBLICATIONS

Machine translation of JP 09-160315 A dated Apr. 30, 2008.*

* cited by examiner

*Primary Examiner*—Sophia S Chen
(74) *Attorney, Agent, or Firm*—Rossi, Kimms & McDowell, LLP

(57) ABSTRACT

An image forming apparatus which can facilitate acquisition of an image output bundle that has a uniform and optimal gloss level as a whole. An image forming apparatus 10 fixes a toner image on a plurality of sheets. An image ratio calculation unit 233 calculates a composition ratio of image types in a plurality of pages of image data. A gloss level control unit 250 provides a control for uniformly fixing toner images formed on the plurality of pages to the plurality of sheets based on the calculation result by the image ratio calculation unit 233.

14 Claims, 20 Drawing Sheets

IMAGE FORMING APPARATUS AND GLOSS LEVEL CONTROL METHOD

BACKGROUND OF THE INVENTION

1. Field of the Invention

The present invention relates to an image forming apparatus and a gloss level control method, and more particularly, to an electrophotographic image forming apparatus that fixes toner image and a gloss level control method for applying to the image forming apparatus.

2. Description of the Related Art

In recent years, image forming apparatuses such as printers and copiers are required to provide image output of higher quality. One criterion for evaluating image quality is a gloss level of a printed image. Especially for a photograph or illustration, an image having high gloss level tends to be preferred.

Factors that control the gloss level of an image in an electrophotographic image forming apparatus are duration and/or temperature of fixing an unfixed toner image onto a sheet such as a paper sheet and OHP film as image carrier by a fixing unit. In other words, the factor is an amount of heat applied to a sheet during fixation. Depending on the amount of heat, melting condition of a toner and/or permeability of a toner into a sheet varies, which causes the gloss level of an image to vary. In general, the more the amount of applied heat increases, the higher gloss level an image has.

Choice of the gloss level of an image depends on a user's preference. Users are likely to want a high gloss level when outputting an image like a photograph or illustration. On the contrary, for business documents, many users prefer a low gloss level because it is difficult for the users to fill in a glossy document with a pen or pencil, for example. However, this is just a general trend, and a gloss level desired for an output image varies from user to user. Thus, there has been a need for an image forming apparatus that can provide an image gloss level that meets a user's request.

Conventionally, for realizing a gloss level desired by a user, there have been known an apparatus that is capable of performing a setting/change of the gloss level of an image according to a user's designation (see Japanese Laid-Open Patent Publication (Kokai) H06-202520, for example), and an apparatus that outputs an image with a gloss level appropriate for the type of the image determined by an image forming apparatus (see Japanese Laid-Open Patent Publication (Kokai) No. H09-160315, for example).

However, as the apparatus disclosed by the Japanese Laid-Open Patent Publication (Kokai) No. H09-160315 selects a gloss level by determining the type of an image for each page, originals including different types of images, e.g. characters and photographs, have different gloss levels from page to page. For this reason, the apparatus is inconvenient for a user who desires to have the same gloss level for an entire output bundle. The apparatus also indicates composition ratio of image types that constitute pages and allows a user to select a desired gloss level. With this apparatus, the user can perform a setting of the same gloss level for the entire output bundle, but the user has to set a gloss level based on the indicated composition ratio of image types by himself.

The apparatus disclosed by the Japanese Laid-Open Patent Publication (Kokai) No. H06-202520 has a drawback in that a user has to determine the ratio of images making up an original, e.g. characters and photographs, and set a gloss level on his own.

SUMMARY OF THE INVENTION

It is an object of the present invention to provide an image forming apparatus and a gloss level control method that facilitates acquisition of an image output bundle that has a uniform and optimal gloss level as a whole.

To attain the above object, in a first aspect of the invention, there is provided an image forming apparatus that fixes toner image on a plurality of recording material, comprising a composition ratio calculation unit that calculates a composition ratio of image types in a plurality of pages of image data, and a fixing level control unit that provides a control for uniformly fixing toner images formed on the plurality of pages to the plurality of recording material based on the calculation result by the composition ratio calculation unit.

With this arrangement, when image formation is performed based on an original including mixed images of difference types such as characters and photographs, control for uniformly fixing toner image onto recording material is provided based on the composition ratio of image types included in the original. The control may be control of temperature or pressure of fixing rollers or control of speed at which each recording medium is conveyed. By providing such control for fixing the toner image onto the recording material uniformly, acquisition of an image output bundle having a uniform and optimal gloss level as a whole can be facilitated.

To attain the above object, in a second aspect of the invention, there is provided an image forming apparatus that fixes toner image on a plurality of recording material, comprising an image type determination unit that determines an image type for each page of an original, a composition ratio calculation unit that calculates a composition ratio of image types in all pages of the original based on the image type determined by the image type determination unit, a gloss level decision unit that decides a gloss level of images to be formed based on the composition ratio of image types calculated by the composition ratio calculation unit, and an image forming unit that forms images having a gloss level decided by the gloss level decision unit.

With such arrangement, when image formation is performed based on an original including mixed images of different types such as characters and photographs, a gloss level for an image output bundle is automatically decided based on the composition ratio of image types included in the original to form images having the decided gloss level. This can facilitate acquisition of an image output bundle having a uniform and optimal gloss level as a whole.

Preferably, the image type determination unit determines the image type based on transition form of a signal indicative of image density in the each page.

More preferably, the image type determination unit determines the image type based on a ratio of high-level duration of a pulse signal obtained by binarizing the signal indicative of image density in the each page to the entire time.

Preferably, the image type determined by the image type determination unit includes at least character image and photograph image.

Preferably, the image forming unit realizes the gloss level decided by the gloss level decision unit by adjusting at least one of fixing temperature, fixing pressure, and fixing speed of a fixing device that fixes the toner image applied to a recording medium thereon.

Preferably, the image forming apparatus further comprises a reception unit that receives a gloss level specified by a user, and a manual image forming unit that forms images having the gloss level received by the reception unit.

With this arrangement, a user can manually set a gloss level, and hence usability can be enhanced.

Preferably, the image forming apparatus further comprises a change instruction receiving unit that receives an instruction to change the gloss level during image formation by the image forming unit, wherein the image forming unit forms images having the changed gloss level in accordance with the instruction to change the gloss level received by the change instruction receiving unit.

With this arrangement, a setting of the gloss level can be changed during image formation and also it can be changed during output if the user is not satisfied with an output image, which can enhance usability.

More preferably, the image forming apparatus further comprises a gloss level change confirmation unit that confirms whether a user approves forming images having the changed gloss level according to the instruction to change the gloss level received by the change instruction receiving unit, wherein the image forming unit forms the images when an instruction indicative of approval of forming images having the changed gloss level is input from the user as a result of confirmation by the gloss level change confirmation unit.

With this arrangement, before changing the gloss level, whether or not the gloss level is changed can be confirmed. This can prevent unintentional change of the gloss level by a user.

Preferably, the image forming apparatus further comprises a gloss level notification unit that notifies the gloss level when the images are formed by the image forming unit.

With this arrangement, the automatically decided gloss level is further informed to a user. This can allow the user to confirm the gloss level at image formation and check it for reference when changing the gloss level, which can provide improved usability.

To attain the above object, in a third aspect of the present invention, there is provided a gloss level control method applied to an image forming apparatus that fixes toner image on a plurality of recording material, comprising an image type determining step of determining an image type in each page of an original, a composition ratio calculating step of calculating a composition ratio of image types in all pages of the original based on the image type determined in the image type determining step, a gloss level decision step of deciding a gloss level of images to be formed based on the composition ratio of image types calculated in the composition ratio calculating step, and an image forming step of causing an image forming unit to form images having a gloss level decided in the gloss level deciding step.

Preferably, the gloss level control method further comprises a receiving step of receiving a gloss level specified by a user, and a manual image forming step of causing the image forming unit to form images having a gloss level received in the receiving step.

Preferably, the gloss level control method further comprises a change instruction receiving step of receiving an instruction to change the gloss level during image formation in the image forming step, wherein the image forming step causes the image forming unit to form images having a changed gloss level in accordance with the instruction to change the gloss level received in the change instruction receiving step.

More preferably, the gloss level control method further comprises a gloss level change conformation step of confirming whether a user approves forming images having the changed gloss level by the image forming unit in accordance with the instruction to change the gloss level received in the change instruction receiving step, wherein the image forming step causes the image forming unit to form the images when an instruction indicative of approval of forming images having the changed gloss level is input from the user as a result of confirmation in the gloss level change confirmation step.

Preferably, the gloss level control method further comprises a gloss level notification step of notifying the gloss level when an image is formed in the image forming step.

The above and other objects, features, and advantages of the invention will become more apparent from the following detailed description taken in conjunction with the accompanying drawings.

BRIEF DESCRIPTION OF THE DRAWINGS

FIG. 5 is a view showing an example of temporal transition of a density control signal associated with a CG image that is created with a personal computer and the like.

DETAILED DESCRIPTION OF THE PREFERRED EMBODIMENTS

The present invention will now be described in detail with reference to the drawings showing a preferred embodiment thereof.

Figure 1:
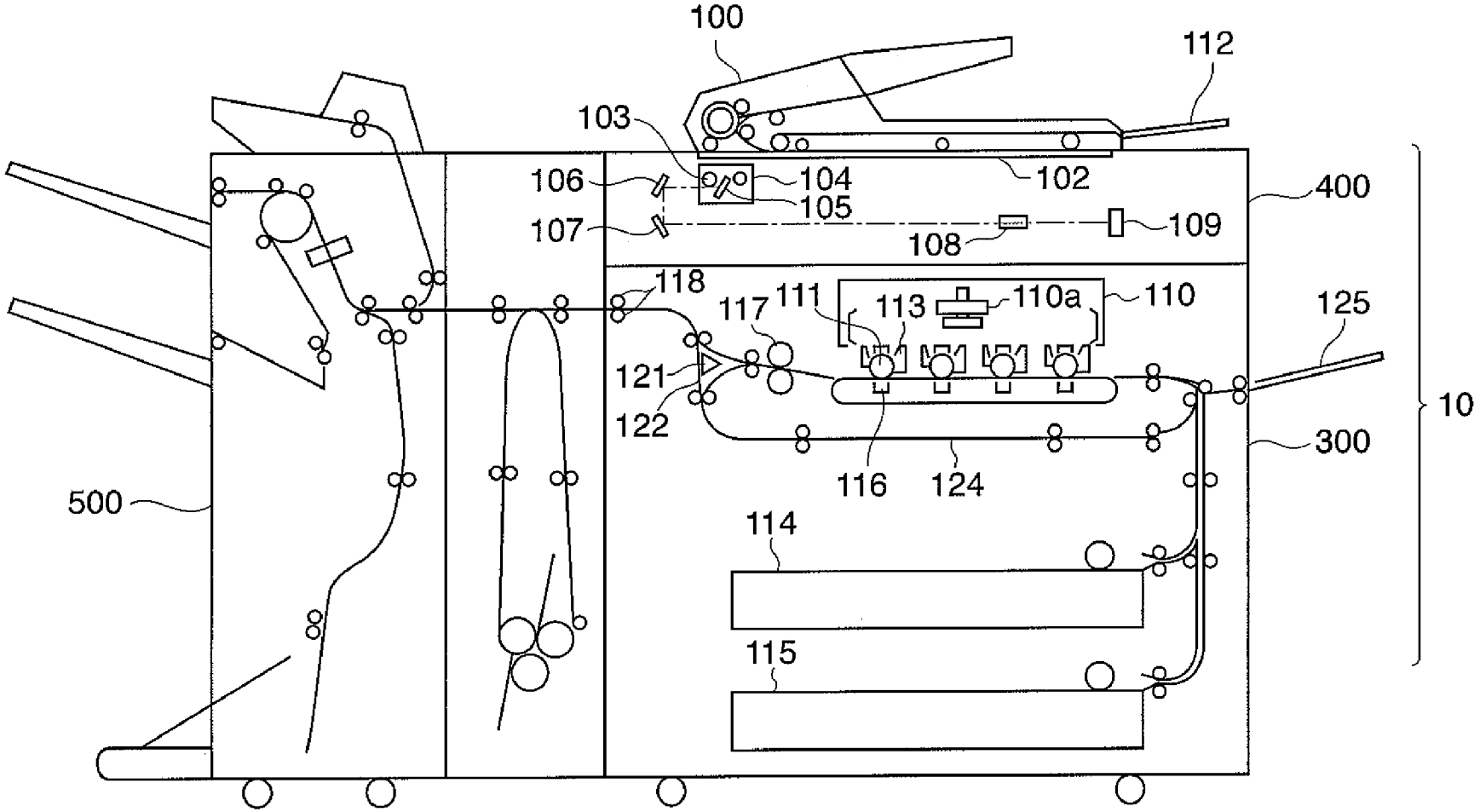
FIG. 1 is a longitudinal cross-sectional view showing the configuration of an image forming apparatus according to an embodiment of the invention.

FIG. 1 is a longitudinal cross-sectional view showing the structure of an image forming apparatus according to an embodiment of the invention.

As shown in FIG. 1, the image forming apparatus is composed of a main body 10 of the image forming apparatus and a post-processing apparatus 500, and the main body 10 includes an image reader 400 for scanning an original image and a printer 300.

The image reader 400 has an original feeding unit 100 thereon. The original feeding unit 100 feeds originals set face up on an original tray leftward as viewed in FIG. 1, one sheet at a time starting from a top page. Each original is conveyed via a curved path onto a platen glass 102 from the left and then conveyed to the right. After this, the original is discharged to an external discharge tray 112. When each original passes an original-through scanning position on the platen glass 102 from the left to the right, an image of the original is scanned by a scanner unit 104 that is located opposite to the original-through scanning position. This method of scanning is generally called "original-through scanning". To be specific, when an original passes the original-through scanning position, a surface of the original to be scanned is illuminated by light of a lamp 103 in the scanner unit 104, and reflected light from the original is guided to a lens 108 via mirrors 105, 106 and 107. After passing through the lens 108, the light is focused onto the image-pickup surface of an image sensor 109.

By conveying an original from left to right over the original-through scanning position in this manner, the original is scanned with the direction orthogonal to the original conveying direction as the main scanning direction and the conveying direction as the sub scanning direction. That is, when the original passes the original-through scanning position, one line of the original image is scanned in the main scanning direction by the image sensor 109, and the original is also conveyed in the sub scanning direction. Consequently, the entire original image is scanned, and the image optically scanned by the image sensor 109 is converted to image data by the image sensor 109 to be output. The image data output from the image sensor 109 is subject to predetermined processing by an image signal control unit, described later, and then is input as a video signal to an exposure control unit 110 of the printer 300.

Alternatively, the original feeding unit 100 may feed an original onto the platen glass 102 and stop it at a predetermined position, where the original is scanned by moving the scanner unit 104 from left to right. This method is so-called "stationary original scanning".

When scanning an original without using the original feeding unit 100, the user first lifts up the original feeding unit 100 and puts an original on the platen glass 102. The scanner unit 104 is caused to move from left to right to scan the original in other words, when scanning an original without using the original feeding unit 100, stationary original scanning is performed.

The exposure control unit 110 of the printer 300 modulates laser light based on the input video signal and outputs the modulated laser light. The laser light is radiated onto photosensitive drums 111*a*, 111*b*, 111*c* and 111*d* corresponding to individual colors (Y, M, C, Bk) while being shifted by a polygon mirror 110*a* (in FIG. 1, one of the four photosensitive drums is denoted as "111", and Y, M, C and Bk correspond to a, b, c and d, respectively). On the photosensitive drums 111*a* to *d*, electrostatic latent images corresponding to the radiated laser light are formed.

The electrostatic latent images on the photosensitive drums 111*a* to 111*d* are made visible with toner that is supplied from developing units 113*a*, 113*b*, 113*c* and 113*d* corresponding to individual colors (Y, M, C, Bk) (in FIG. 1, one of the four developing units is denoted as "131"). In timing synchronous with the start of laser light radiation, a sheet is fed from one of cassettes 114 and 115, a manual sheet feeding unit 125 and a double-side conveying path 124, and the sheet is conveyed to each space between the photosensitive drums 111*a* to 111*d* and transfer units 116*a* to 116*d* (in FIG. 1, one of the four transfer units is denoted as "116"). Toner images formed on the photosensitive drums 111*a* to 111*d* are transferred to the fed sheet by the transfer units 116*a* to 116*d*.

The sheet on which the toner images have been transferred is conveyed to a pair of fixing roller 117, where heat is applied to the paper under pressure so as to fix the toner image onto the sheet. After passing through the fixing rollers 117, the sheet is discharged from the printer 300 to an external device (folding unit 500) via a flapper 121 and a pair of discharging roller 118.

When the sheet is discharged with a surface on which the image is formed facing downward, the sheet having passed through the fixing unit 117 is guided once into an inversion path 122 by a switching action of the flapper 121. After the back end of the sheet passed the flapper 121, the sheet is switched back to be guided to the discharging rollers 118 and discharged from the printer 300 by the discharging rollers 118. The sheet inverted discharging is executed when image formation is performed in order from the top page, such as when a scanned image is formed as an image using the original feeding unit 100, or when image formation is performed based on image data sent from an external apparatus. Consequently, the sheets discharged by the sheet inverted discharging are stacked in a correct order.

When a hard sheet such as an OHP sheet is fed from the manual sheet feeding unit 125 to have an image formed thereon, the sheet is not led to the inversion path 122, but is discharged by the discharging rollers 118 with surfaces thereof on which images are formed facing upward.

When double-side recording for forming images on both sides of a sheet is set, the sheet is guided to the inversion path 122 by switching action of the flapper 121 and then conveyed to a double-side conveying path 124, and from there, the sheet is controlled to be fed again to each space between the photosensitive drums 111*a* to 111*d* and the transfer units 116*a* to 116*d* in the timing described above.

The sheet discharged from the printer 300 is fed to the post-processing apparatus 500, which can apply processing such as bookbinding, stapling, or punching.

Figure 2:
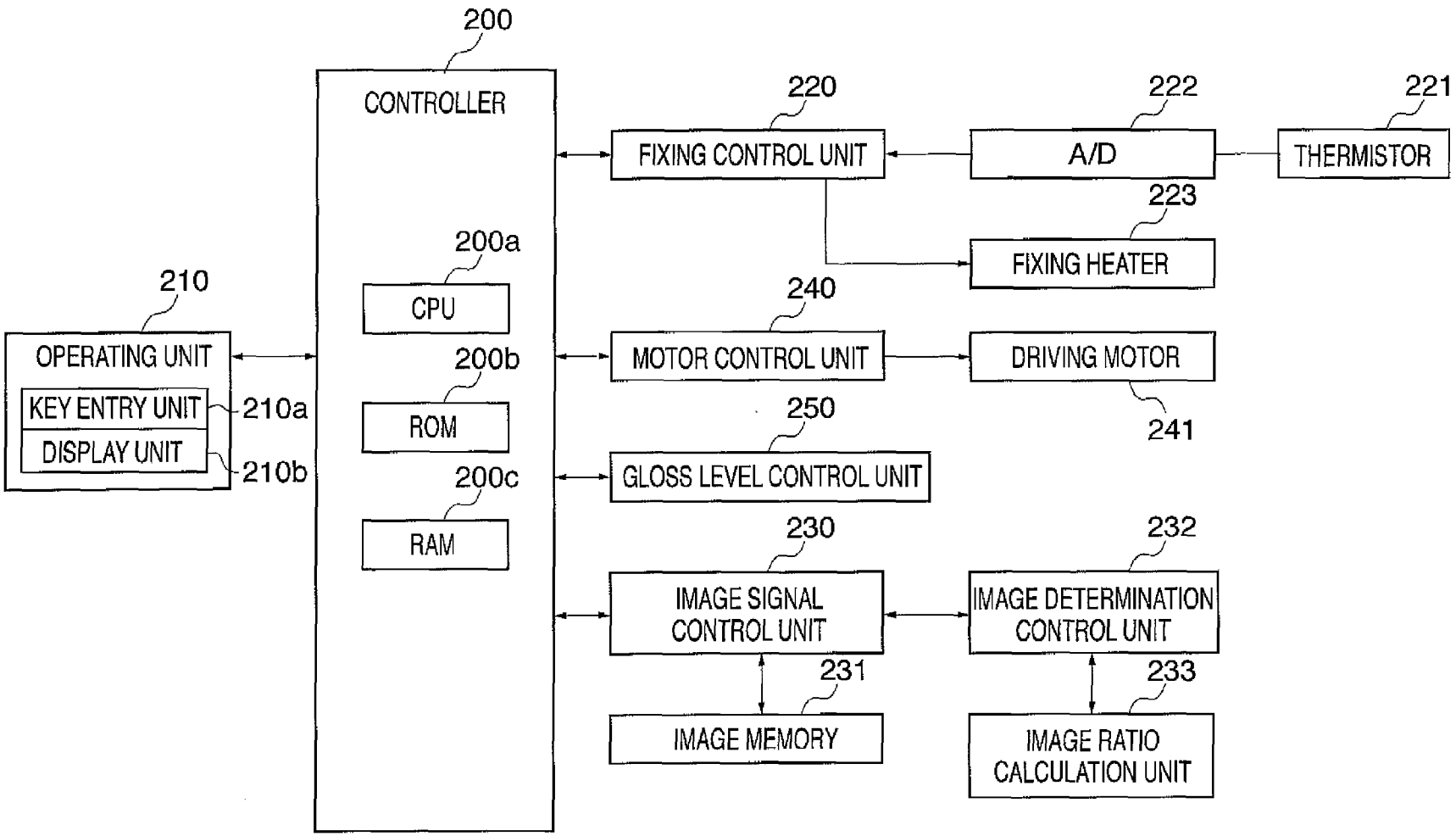
FIG. 2 is a block diagram showing the configuration of the control unit that provides operation control of the image forming apparatus shown in FIG. 1.

FIG. 2 is a block diagram showing the configuration of a control unit that provides operation control of the image forming apparatus shown in FIG. 1.

In FIG. 2, a controller 200 may include a CPU 200*a*, ROM 200*b*, and RAM 200*c*. The CPU 200*a* executes a control program stored in the ROM 200*b*, thereby executing various processing involved in image formation.

An operation unit 210 includes a key entry unit 210*a* and a display unit 210*b*. The key entry unit 210*a* may have a copy mode setting key, a number of copies setting key, a copy start key, a copy stop key, and a reset key for returning operation mode to default state (all not shown). The display unit 210*b* may be a LED or liquid display device not shown, indicating settings of operation mode and/or entry keys that can be operated by clicking a pointing device.

A thermistor 221 detects the surface temperature of the fixing rollers 117, and an analog value of the detected surface temperature is converted to a digital value by an A/D converter 222 to input to a fixing control unit 220. A fixing heater 223 for heating the fixing rollers 117 is connected to the fixing control unit 220. The fixing control unit 220 controls the fixing heater 223 based on the input value of detected surface temperature of the fixing roller 117 so that the surface temperature of the fixing roller 117 assumes a predetermined value determined in accordance with a gloss level control signal, described later.

An image memory 231 and an image determination control unit 232 are connected to the image signal control unit 230, and an image ratio calculation unit 233 is connected to the image determination control unit 232. In the image memory 231, image signal data from the image signal control unit 230 is temporarily stored. The image determination control unit 232 reads via the image signal control unit 230 image signal data temporarily stored in the image memory 231 and determines the type of an image (e.g., character, photograph, or computer graphics image). The image ratio calculation unit 233 calculates a ratio of various types of images in all pages that make up an image output bundle based on image types determined by the image determination control unit 232.

A driving motor 241 is connected to the motor control unit 240. The driving motor 241 collectively represents a plurality of motors for driving various conveyance rollers, the photosensitive drums 111*a* to 111*d* and fixing rollers 117, and the motor control unit 240 controls driving of the driving motor 241.

A gloss level control unit 250 provides control of the fixing control unit 220 and the motor control unit 240 for switching a gloss level or changing a gloss level during an image output based on setting information sent from the operation unit 210 as well as data on the composition ratio of image types in all pages constituting an image output bundle that is output from the image signal control unit 230.

The fixing control unit 220, motor control unit 240, gloss level control unit 250, image signal control unit 230, image determination control unit 232, and image ratio calculation unit 233 operate by the CPU 200*a* of the controller 200 executing a control program stored in the ROM 200*b*. The fixing control 220 and motor control unit 240 also include current driven circuits.

Prior to a description of image type determination performed by the image determination control unit 232, the principle of the determination will be described.

Figure 3:
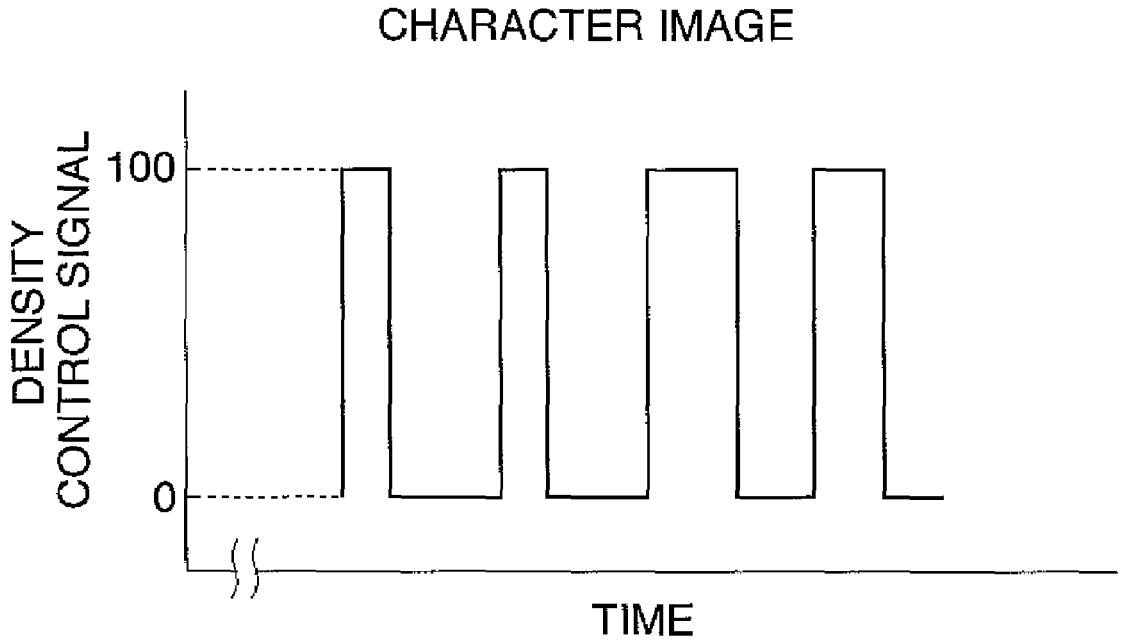
FIG. 3 is a view showing an example of temporal transition of a density control signal associated with a character image.
Figure 4:
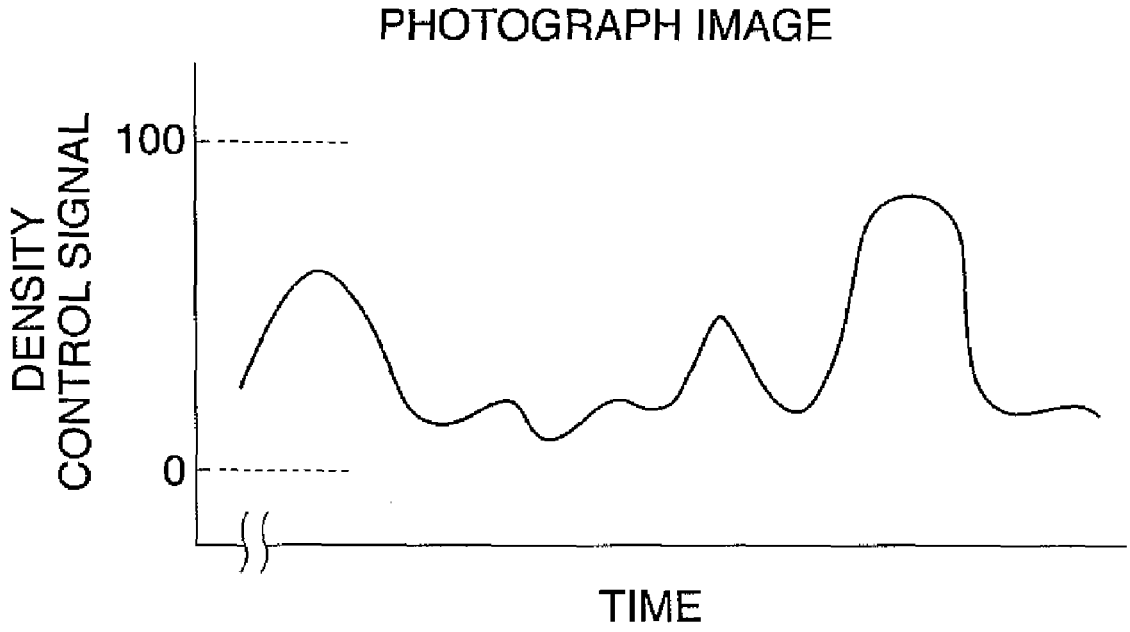
FIG. 4 is a view showing an example of temporal transition of a density control signal associated with a photograph image that is formed of halftones.
Figure 5:
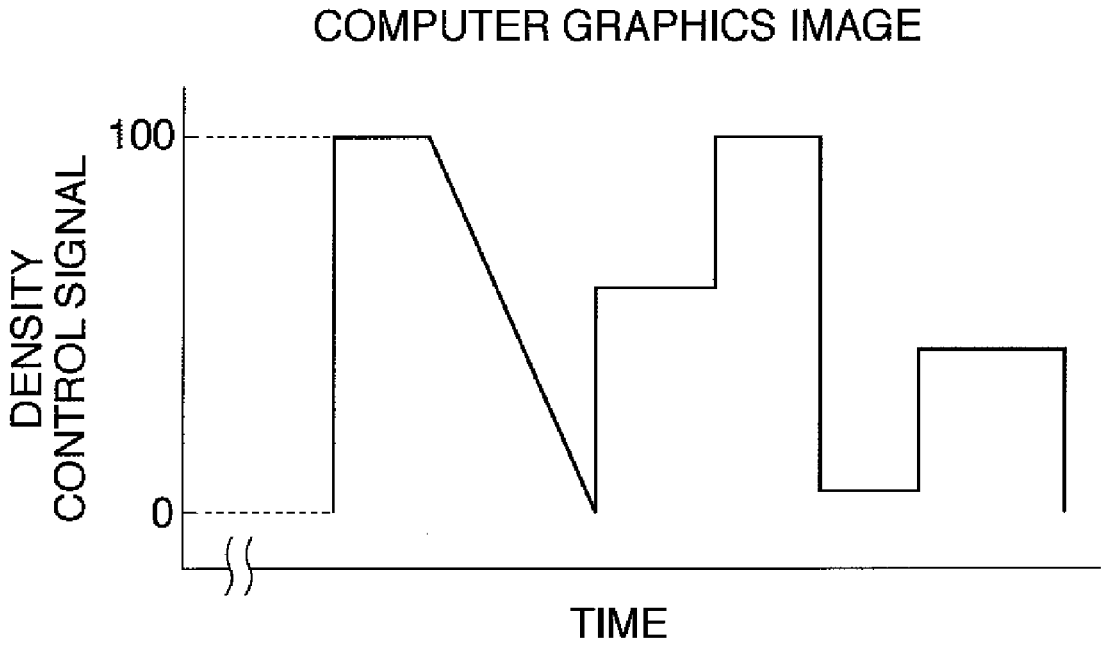

FIGS. 3 to 5 show typical temporal transition of each density control signal for images of different types. The density control signal is a signal indicating the density of an image, representing the maximum density as 100 and the minimum density as 0, which is obtained when an image is scanned along a main scanning line (i.e., the direction orthogonal to the conveying direction of originals). In the present image forming apparatus, the density control signal corresponds to a video signal that is used for modulation of laser light in the exposure control unit 110 of the printer 300 or to image signal data that is temporarily stored in the image memory 231. The temporal transition also represents spatial transition in the main scanning direction on an image.

FIG. 3 is a view showing an example of temporal transition of density control signal associated with a character image.

The density control signal associated with a character image shows the maximum density of 100 in a character portion and shows the minimum density of 0 in a sheet portion other than characters, thus having a signal form of rectangular wave.

FIG. 4 is a view showing an example of temporal transition of a density control signal associated with a photograph image that is formed of halftones.

The density control signal associated with a photograph image is typically smaller than the maximum density of 100 and greater than the minimum density of 0, being a signal indicating continuous variation without regularity.

FIG. 5 is a view showing an example of temporal transition of a density control signal for a computer graphics (hereinafter "CG") image that can be created with a personal computer.

The density control signal associated with a CG image has a signal form similar to that of the density control signal for a character image, but indicates the maximum density for a longer duration than the character image (i.e., the CG image has a larger image area that indicates the maximum density than the character image). Also, transition of the density control signal for the character image is irregular, whereas the density control signal for the CG image varies linearly.

By utilizing such differences in forms of density control signals among different image types, the image determination control unit 232 determines the type of an image based on a density control signal. To start with, a first image type determination method will be described.

Figure 6:
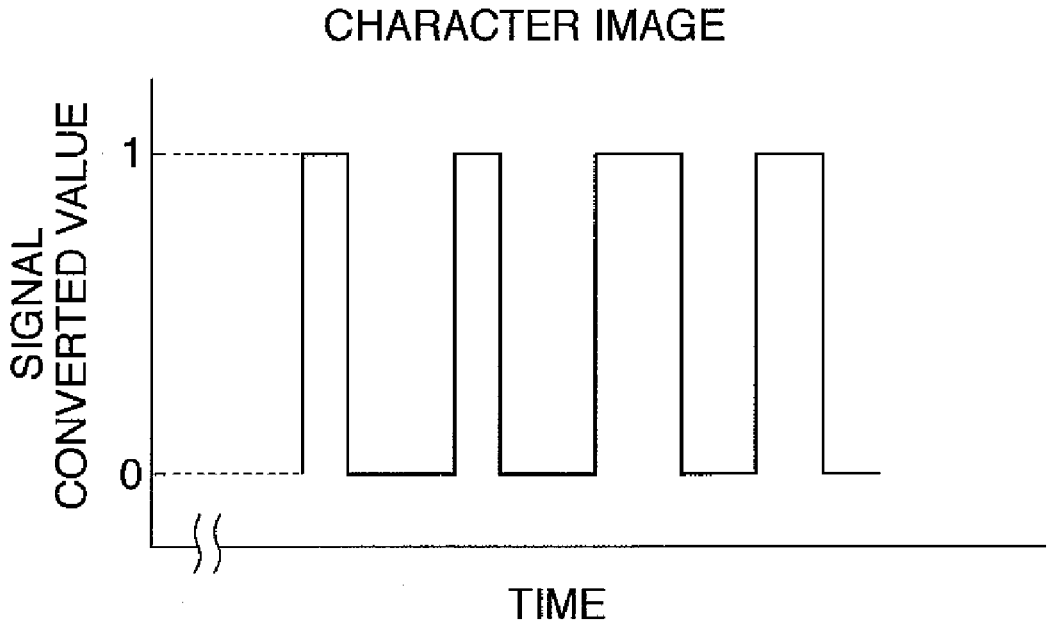
FIG. 6 is a view showing signal-converted values that result from binarization of the density control signal for the character image shown in FIG. 3.
Figure 7:
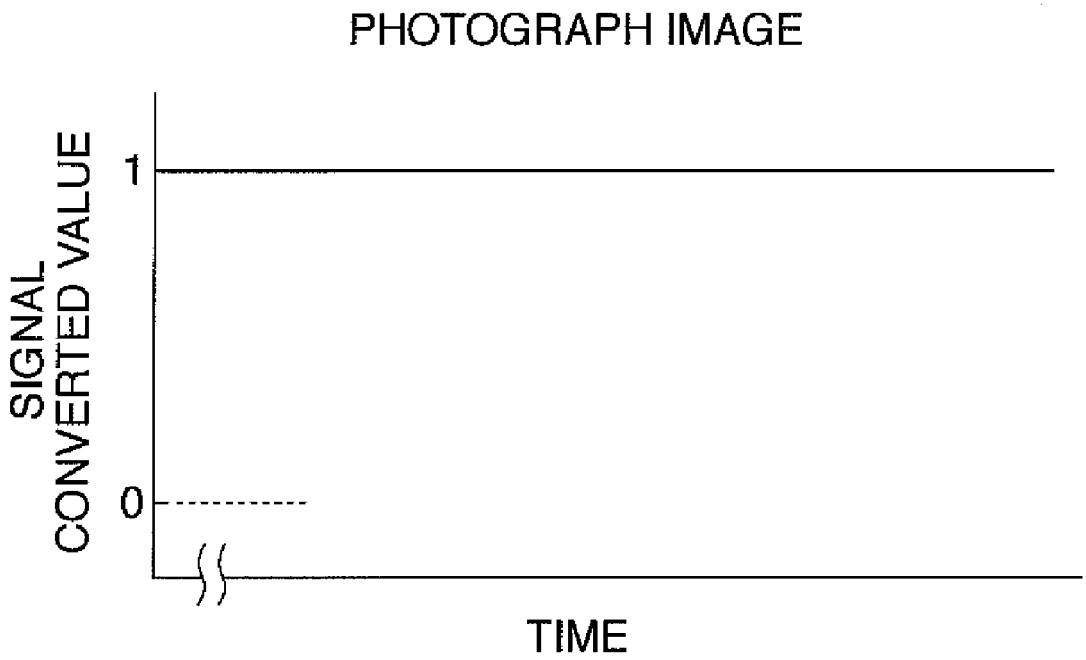
FIG. 7 is a view showing signal-converted values that result from binarization of the density control signal for the photograph image shown in FIG. 4.
Figure 8:
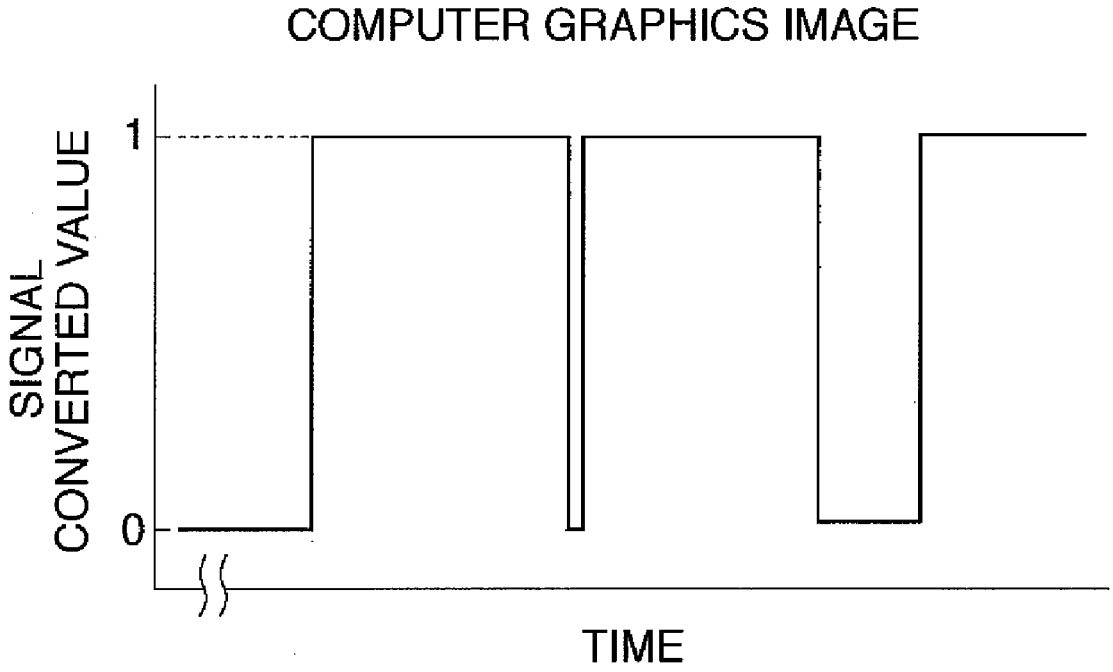
FIG. 8 is a view showing signal-converted values that result from binarization of the density control signal for the CG image shown in FIG. 5.

Based on the density control signals shown in FIGS. 3 to 5, binarization with an image area having a density greater than 0 as "1" and a non-image area having a density of 0 as "0" results in values shown in FIGS. 6 to 8.

FIG. 6 is a view showing a signal-converted value that results from binarization of the density control signal for the character image shown in FIG. 3. A feature of the character image is that waveforms before and after binarization are the same.

FIG. 7 is a view showing signal-converted values that result from binarization of the density control signal for the photograph image of FIG. 4. Since almost the entire area of a photograph image is an image area, a photograph image has a characteristic that the signal-converted values after binarization are all "1".

FIG. 8 is a view showing signal-converted values resulting from binarization of the density control signal for the CG image shown in FIG. 5. The CG image is characterized by the fact that it has more areas with a signal-converted value of "1" than the character image.

Figure 9:
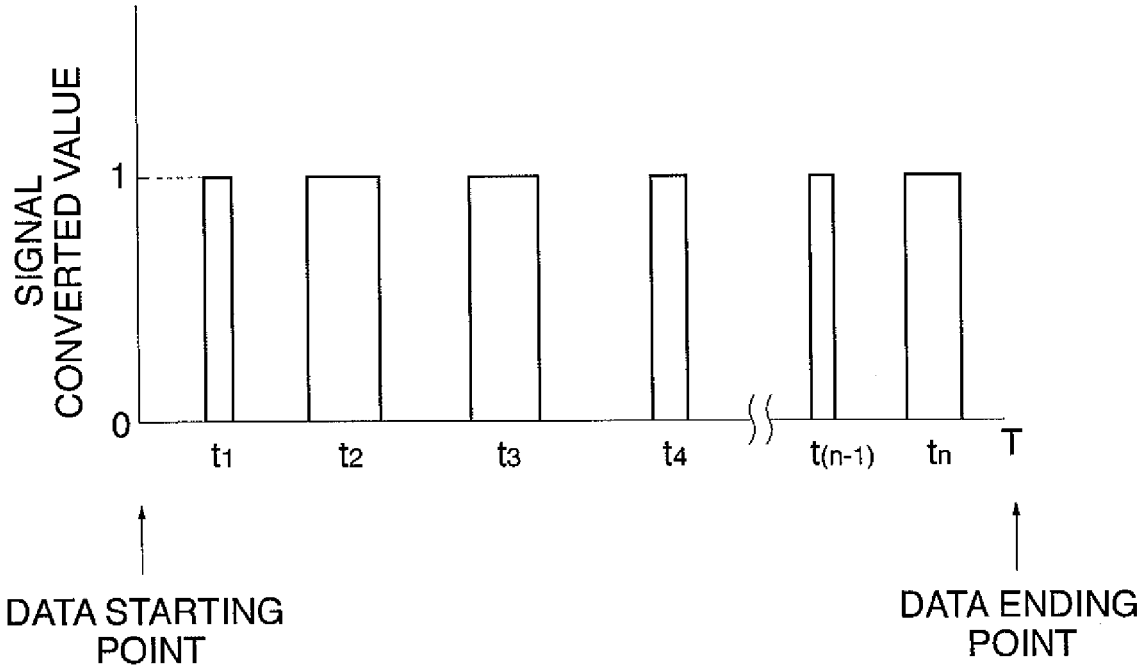
FIG. 9 is a view showing a typical form of the signal-converted values shown in FIGS. 6 to 8.

FIG. 9 is a view showing a typical form of the signal-converted values that are shown in FIGS. 6 to 8.

In FIG. 9, the symbols of "t1" to "tn" indicate durations for which a signal-converted value assumes "1", and T represents the total time from a starting time to an ending time of outputting a density control signal (i.e., a signal-converted value) for one page of image.

Using the durations "t1" to "tn" and the total time T, the image determination control unit 232 determines the type of an image according to the following formulas (1) to (3). That is, the image determination control unit 232 determines that the type of an image meeting formula (1) is a character image, that of an image meeting formula (2) is a CG image, and that of an image meeting formula (3) is a photograph image.

$$\Sigma ti < T/a \quad (1)$$

$$T/a \leqq \Sigma ti < T/b \quad (2)$$

$$T/b \leqq \Sigma ti \quad (3)$$

where i=1, . . . , n, and a and b are constants having a relation of a>b, e.g., a=5 and b=2.

Although the first image type determination method determines an image type based on a density control signal for the entire area of one page of image, an image type may be also determined based on a density control signal for predetermined partial areas of one page of image. This method will be described below as the second image type determination method.

Figure 10A:
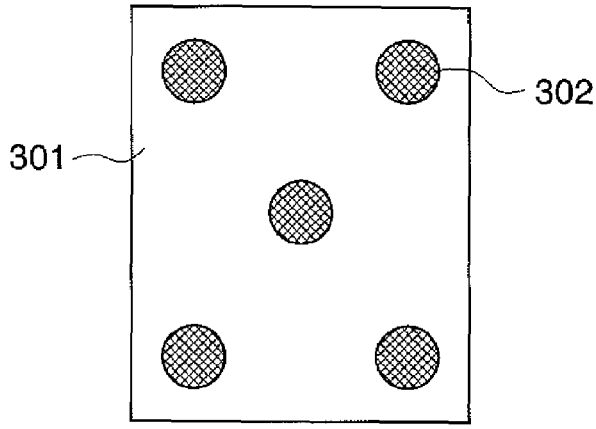
FIG. 10A is a view showing a plurality of determination areas provided in a rendering area that is equivalent to the entire image area of one page.
Figure 10B:
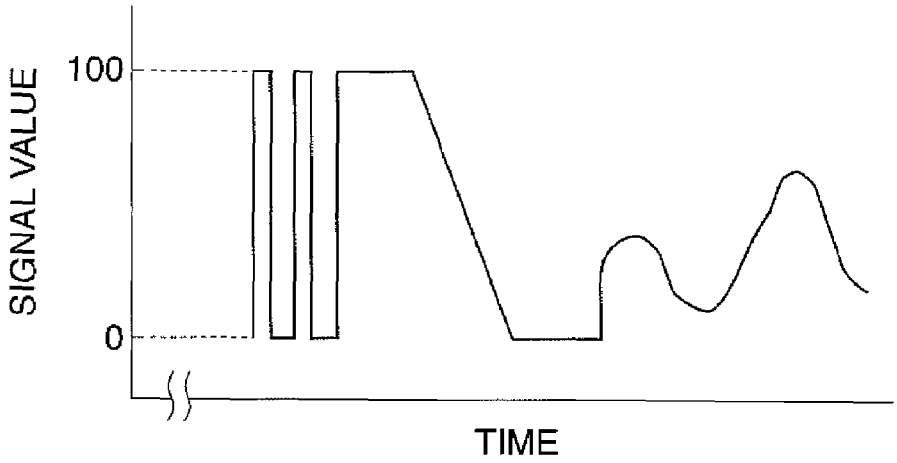
FIG. 10B is a view showing density control signals obtained in each of the determination areas.
Figure 10C:
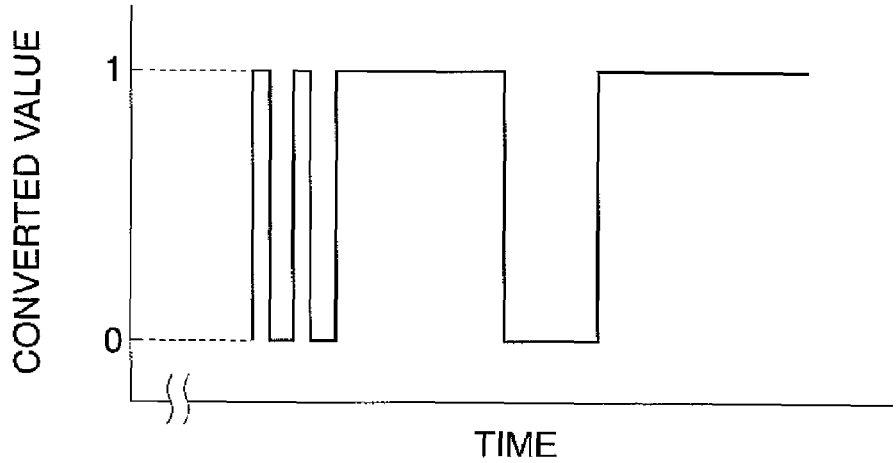
FIG. 10C is a view showing signal-converted values that result from binarization of the density control signals.

FIG. 10 is a view useful in explaining the second image type determination method. FIG. 10A shows a plurality of determination areas 302 provided in a rendering area 301 that is equivalent to the entire image area of one page; FIG. 10B shows density control signals obtained in each of the determination areas 302; and FIG. 10C shows signal-converted values that result from binarization of the density control signals.

That is, the second image type determination method determines an image type based on binarized signal-converted values (see FIG. 10C) in each of the determination areas 302. Compared to the first method, this can reduce the storage capacity of the image memory 231 for temporarily storing image signal data necessary for determination of the image type and also shorten time required for determination of the image type.

It should be noted that the total area of the determination areas 302 accounts for approximately 20% of the rendering area 301 and the determination areas 302 are distributed in the rendering area 301 as uniformly as possible. In the example shown in FIG. 10, the determination areas 302 are distributed among five locations, i.e., upper right, lower right, upper left, lower left, and center. The number of determination areas 302 is not limited to five and its total area to about 20% of the rendering area 301; there may be more determination areas 302 or they may have a larger total area so that an image type can be determined more accurately. Conversely, there may be less determination areas 302 or their total area may be reduced so as to reduce the storage capacity of the image memory 231 and shorten time required for image type determination.

Subsequently, based on image types contained in each page that are obtained in the image type determination performed for each page of image as in the first image type determination method, or based on an image type in each determination area that is obtained in the image type determination performed for each determination area as in the second image type determination method, the image ratio calculation unit 233 (FIG. 2) calculates the composition ratio of image types contained in one bundle of originals (i.e., all pages). This will be described below with reference to FIG. 11.

Figure 11:
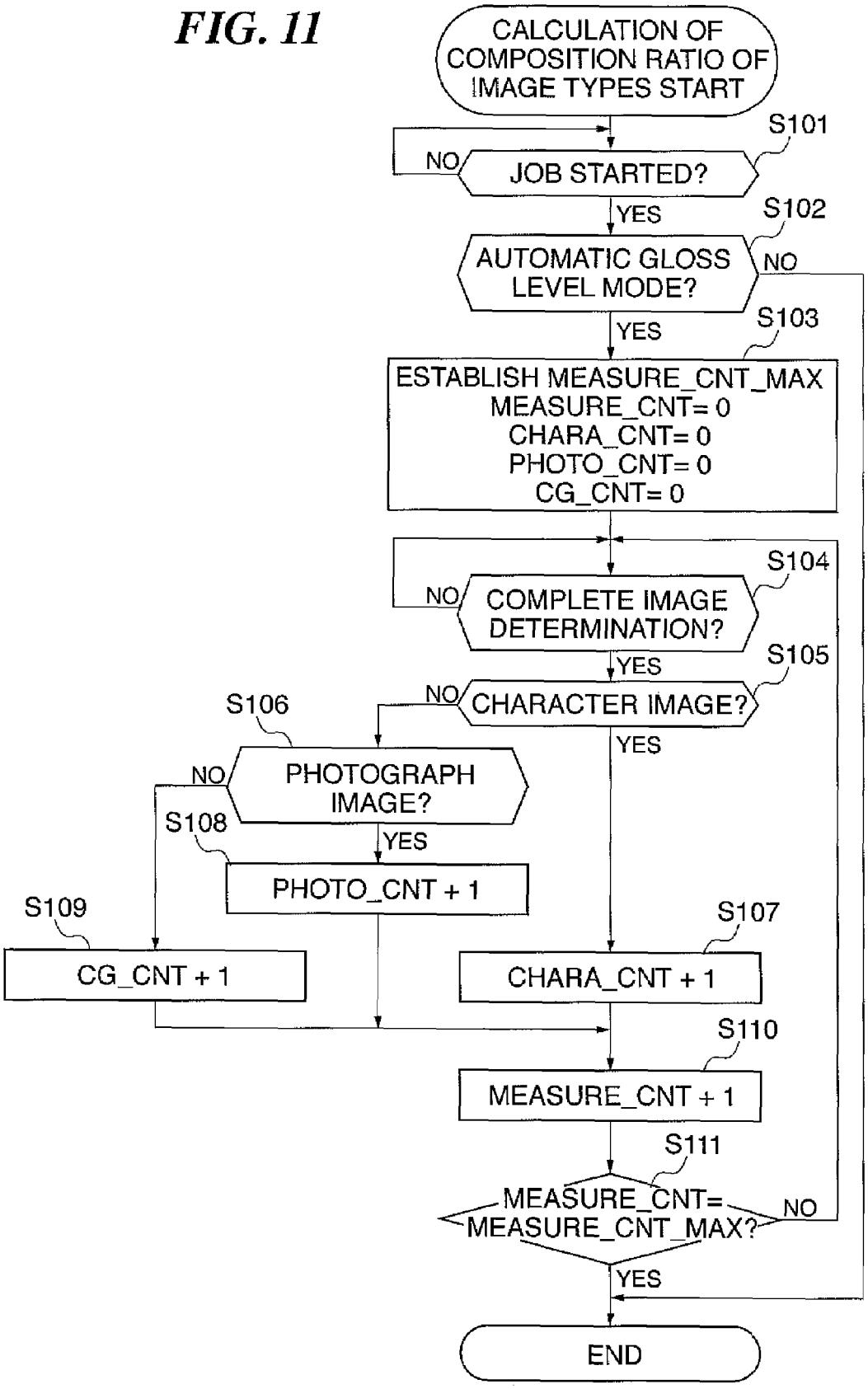
FIG. 11 is a flowchart showing the procedure of calculation processing of the composition ratio of image types that is implemented by an image ratio calculation unit.

FIG. 11 is a flowchart showing the procedure of calculation processing of the composition ratio of image types that is performed by the image ratio calculation unit 233.

In a step S101, the procedure waits for an image forming job to be started, and when an image forming job is started, it proceeds to a step S102.

In the step S102, it is determined whether or not an automatic gloss level mode is specified, and if the automatic gloss level mode is specified, the procedure proceeds to a step S103, otherwise, the calculation process is terminated.

In a step S103, the number of determinations MEASURE_CNT_MAX which indicates the number of image type determinations that should be done by the image determination control unit 232 is established. When the first image type determination method is applied, the determination of the image type is performed for each page, so that the number of determinations MEASURE_CNT_MAX represents the total number of pages of one-bundle original. For example, for a bundle of 50-page originals, the number of determinations MEASURE_CNT_MAX represents MEASURE_CNT_MAX=50. When the second image type determination method is applied, the determination of the image type is executed for each determination area, so that MEASURE_CNT_MAX represents the product of the number of determination areas per page and the total number of pages. For example, for a bundle of 50-page originals with five determination areas per page, the number of determinations MEASURE_CNT_MAX represents MEASURE_CNT_MAX=50*5=250.

In addition, in a step S103, both a determination counter MEASURE_CNT for counting the actual number of times the image type determination is performed and an image determination counter CHARA_CNT for counting the number of times image type is determined as a character image are initialized to zero. An image determination counter PHOTO_CNT for counting the number of times the image type is determined as a photograph image and an image determination counter CG_CNT for counting the number of times the image type is determined as a CG image are also initialized to zero, and the procedure proceeds to a step S104.

In the step S104, the procedure waits for completion of the image type determination for one page in the first image type determination method or for one determination area in the second method, then it proceeds to a step S105.

In the step S105, it is determined whether the result of the image type determination done in a step S104 is a character image or not, and if it is a character image, the procedure proceeds to a step S107, otherwise, to a step S106. In the step S107, the image determination counter CHARA_CNT is incremented by one, and the procedure proceeds to a step S110.

In the step S106, it is determined whether the result of the image type determination done in the step S104 is a photograph image or not, and if it is a photograph image, the procedure proceeds to a step S108, otherwise, to a step S109. In the step S108, the image determination counter PHOTO_CNT is incremented by one, and the procedure proceeds to the step S110.

In the step S109, the image determination counter CG_CNT is incremented by one, and the procedure proceeds to the step S110.

In the step S110, since the image type determination for one page or for one determination area has been complete, the determination counter MEASURE_CNT is incremented by one, and the procedure proceeds to a step S111.

In the step S111, it is determined whether the value of the determination counter MEASURE_CNT indicating the number of times determination has been executed is equal to that of determinations MEASURE_CNT_MAX indicating the target number of determination executions, and if they are equal, the calculation process is terminated. If they are not equal yet, however, the procedure returns to the step S104.

By performing calculation processing of the composition ratio for each image type, the composition ratio of the image types in an image output bundle (i.e., all image pages) can be determined. For example, assume a result where the number of determinations MEASURE_CNT_MAX=100, image determination counter for CG image CG_CNT=20, image determination counter for photograph image PHOTO_CNT-30, and image determination counter for character image CHARA_CNT=50. This means that it is determined that CG images account for 20%, photograph images 30%, and character images 50% of a 100-page image output bundle (i.e., all image pages).

It should be noted that the types of image are not limited to three as described above, but images may be grouped into four or more types by providing more determination criteria for the image type determination.

The composition ratio of image types in an image output bundle thus obtained by the image ratio calculation unit 233 is notified to the gloss level control unit 250 shown in FIG. 2.

Next, a gloss level switching control implemented by the gloss level control unit 250 will be now described. Initially, three methods for controlling the gloss level of an image will be described.

Figure 12:
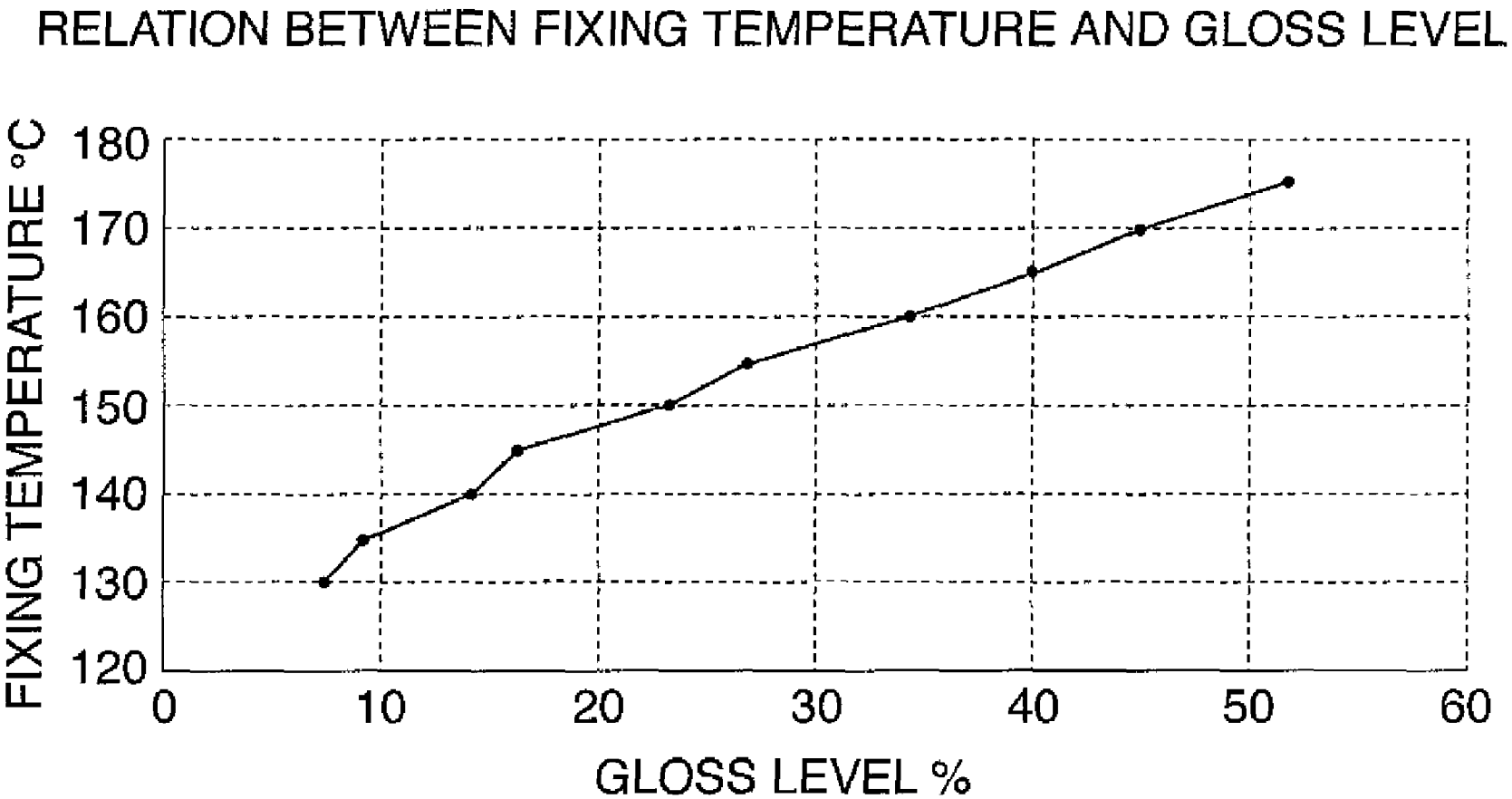
FIG. 12 is a view showing relation between the fixation temperature and the gloss level of an output image.

FIG. 12 is a view showing a relation between fixation temperature and the gloss level of an output image.

In general, the higher fixation temperature is, the more a toner close to the surface of a toner-formed image melts and becomes smooth, so that an output image has a higher gloss level. Therefore, the control of the fixation temperature can provide an output image having a desired gloss level.

Figure 13:
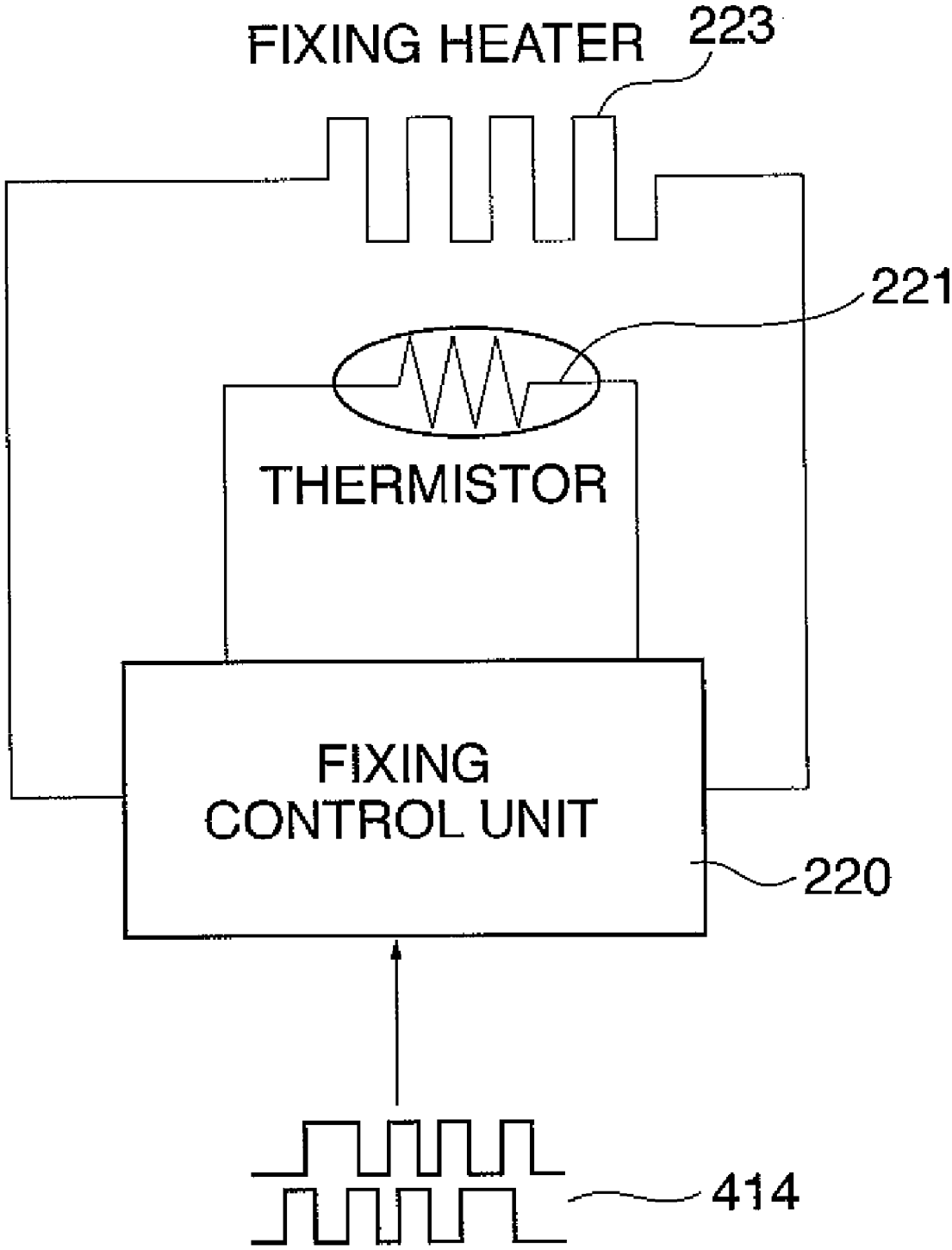
FIG. 13 is a view showing a circuit configuration to which a first gloss level control method is applied with a fixation control unit controlling the temperature of a fixation heater.

FIG. 13 is a view showing a circuit configuration to which the first gloss level control method is applied, where the fixing control unit 220 controls the temperature of the fixing heater 223.

Upon being notified of the composition ratio of image types in an image output bundle from the image ratio calculation unit 233, the gloss level control unit 250 decides an image gloss level at the time of image output based on a user's instruction input from the operation unit 210 and the composition ratio of image types in the image output bundle by way of processing shown FIGS. 22 and 23, described later, and outputs a gloss level control signal 414 to the fixing control unit 220.

The fixing control unit 220 controls the temperature of the fixing heater 223 based on the gloss level control signal 414 and the surface temperature of the fixing roller 117 detected by the thermistor 221. That is, the fixing control unit 220 controls the fixing heater 223 to have a predetermined target temperature which is determined according to the gloss level control signal 414. This target temperature is predetermined such that an optimal gloss level dependent on an image type is obtained.

Figure 14:
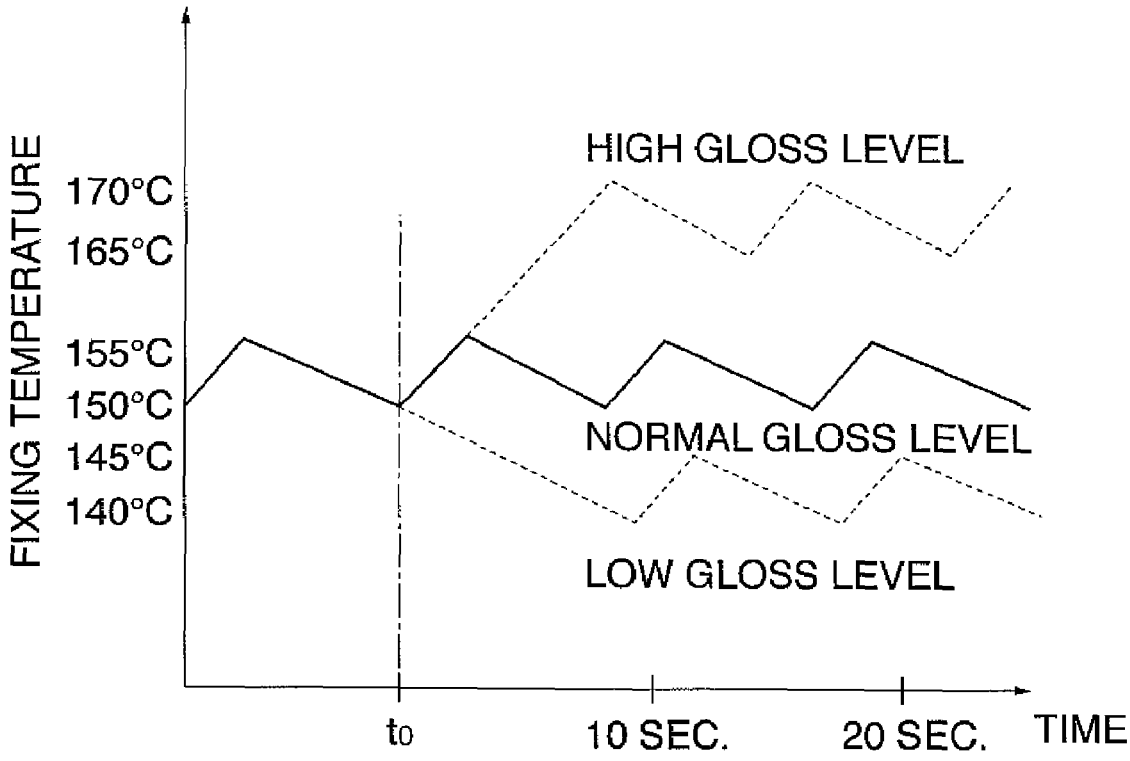
FIG. 14 is a view showing relation between the surface temperature (i.e., fixation temperature) of a fixation roller as measured by a thermistor and elapsed time.

FIG. 14 is a view showing the relationship between the surface temperature (i.e., fixing temperature) of the fixing roller 117 as measured by the thermistor 221 and elapsed time.

When a high gloss level is indicated by the gloss level control signal 414 at time t0, the fixing control unit 220 controls the fixing heater 223 so that a predetermined target temperature appropriate for the indicated level is detected by the thermistor 221. And then, until fixation of the image is complete, the fixing control unit 220 controls the fixing heater 223 to maintain the target temperature.

For example, when fixing temperature corresponding to a normal gloss level is 150° C., by increasing the fixing temperature to approximately 170° C., the gloss level can be increased to about 45% and thus a glossy image can be output. Also, by decreasing the fixing temperature to about 140° C., the gloss level can be decreased to about 10%.

The second gloss level control method that can be implemented by the gloss level control unit 250 will be described below.

Figure 15:
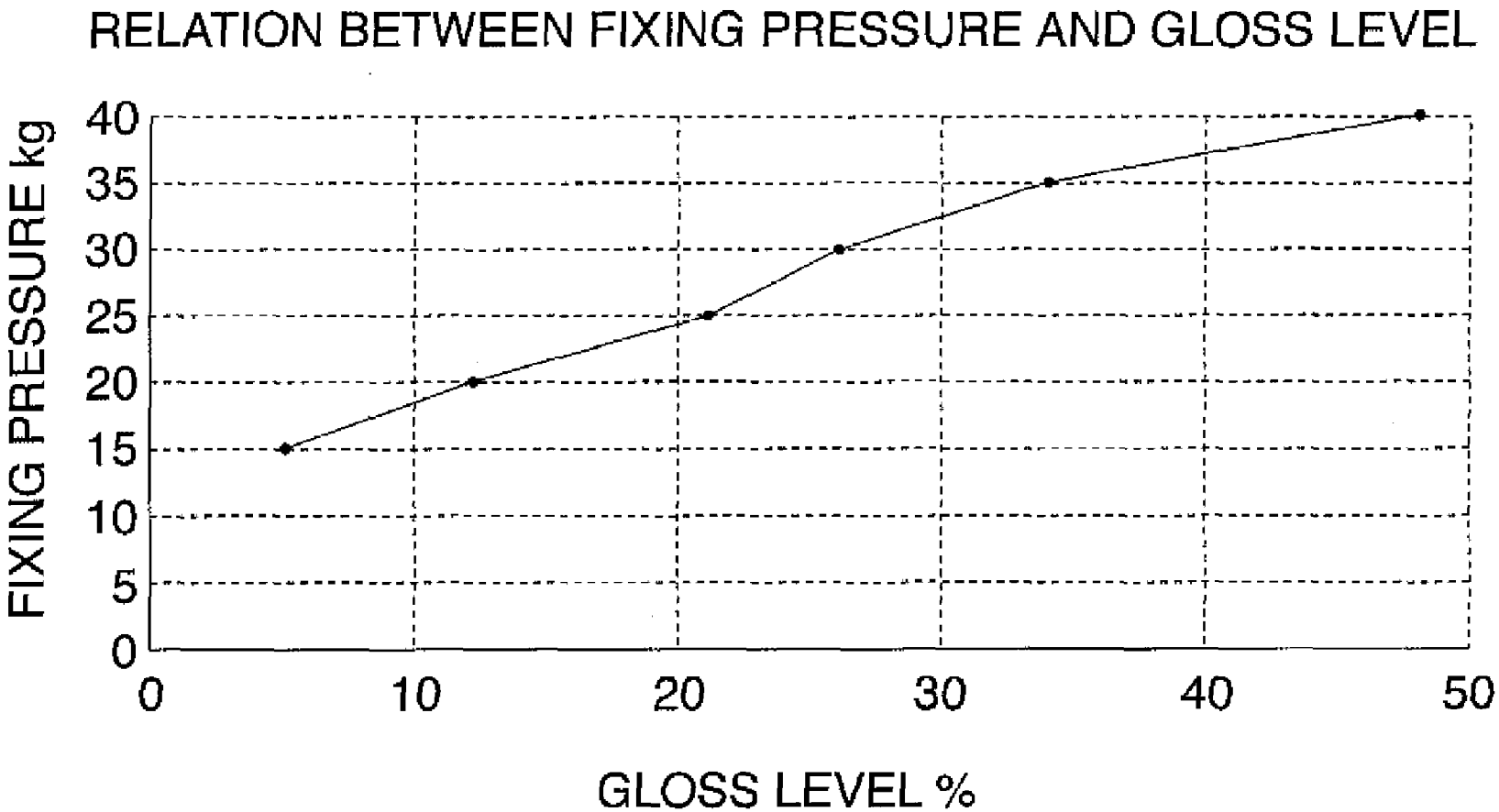
FIG. 15 is a view showing relation between fixation pressure and the gloss level of an output image.

FIG. 15 is a view showing the relation between fixing pressure and the gloss level of an output image.

In general, the higher fixing pressure is, the higher the gloss level of a toner-formed image is. Thus, by controlling the fixing pressure, an output image having a desired gloss level can be obtained.

Figure 16:
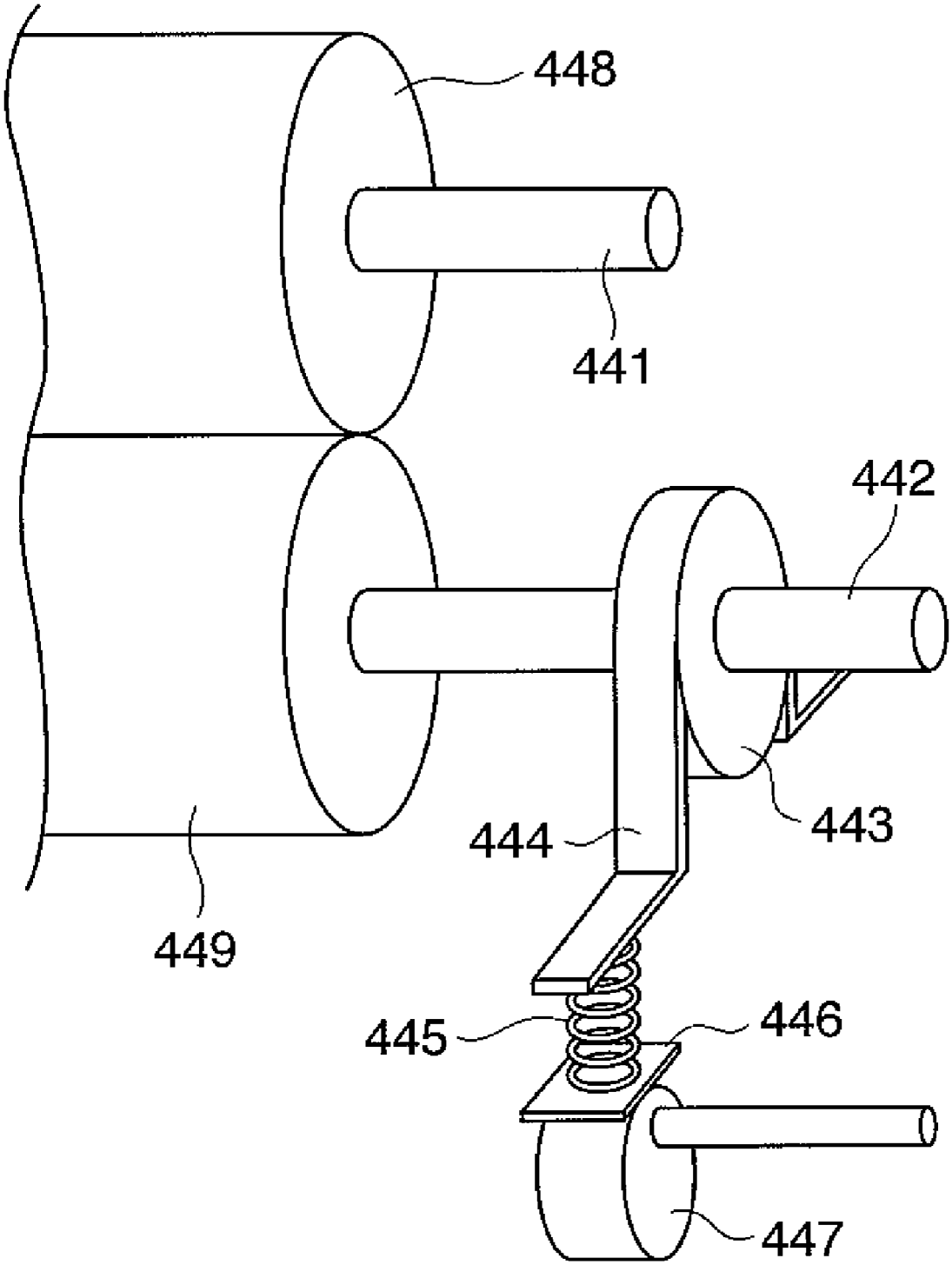
FIG. 16 is a view showing an arrangement to which the second gloss level control method is applied with the fixation control unit controlling the fixation pressure of the fixation roller.

FIG. 16 is a view showing an arrangement to which the second gloss level control method is applied, where the fixing control unit 220 controls the fixing pressure of the fixing rollers 117 in FIG. 1.

As shown in FIG. 16, the fixing rollers 117 in FIG. 1 includes a fixing roller 448 that rotates about the axis 441 and is fixed in its spatial position and a fixing roller 449 that rotates about the axis 442 and can move its spatial position to apply pressure. In the fixing roller 449, a pushing force operates toward the fixing roller 448 from a spring 445 for regulating fixing pressure via a bearing 443 and a bearing support 444. A force exerted by the spring 445 is controlled by the rotation position of a variable cam 447 that controls the position of a spring support 446.

That is, when an image is output, the fixing control unit 220 drives a motor (not shown) for rotating the variable cam 447 in accordance with the gloss level control signal 414 so as to rotate the variable cam 447 at a predetermined rotation position.

Figure 17:
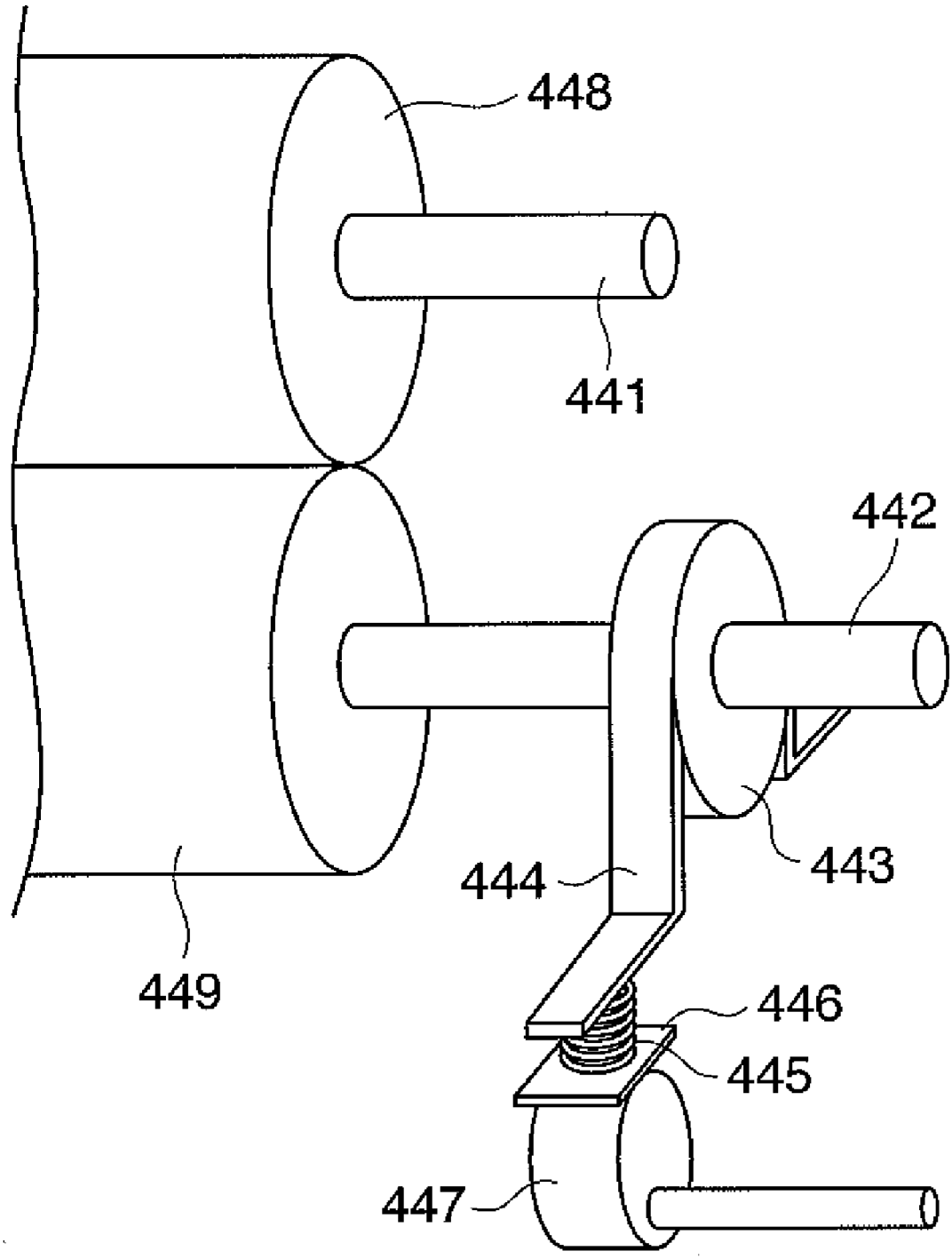
FIG. 17 is a view showing the cam position of a variable cam at which pushing force from the fixation roller to the other fixation roller is largest.

FIG. 16 shows the cam position of the variable cam 447 at which the pushing force from the fixation roller 449 to the fixation roller 448 is smallest and thus an image with a low gloss level is output. FIG. 17 shows the cam position of the variable cam 447 at which the pushing force from the fixation roller 449 to the fixation roller 448 is largest and thus an image with a high gloss level is output.

The third gloss level control method that can be implemented by the gloss level control unit 250 will be described below.

Figure 18:
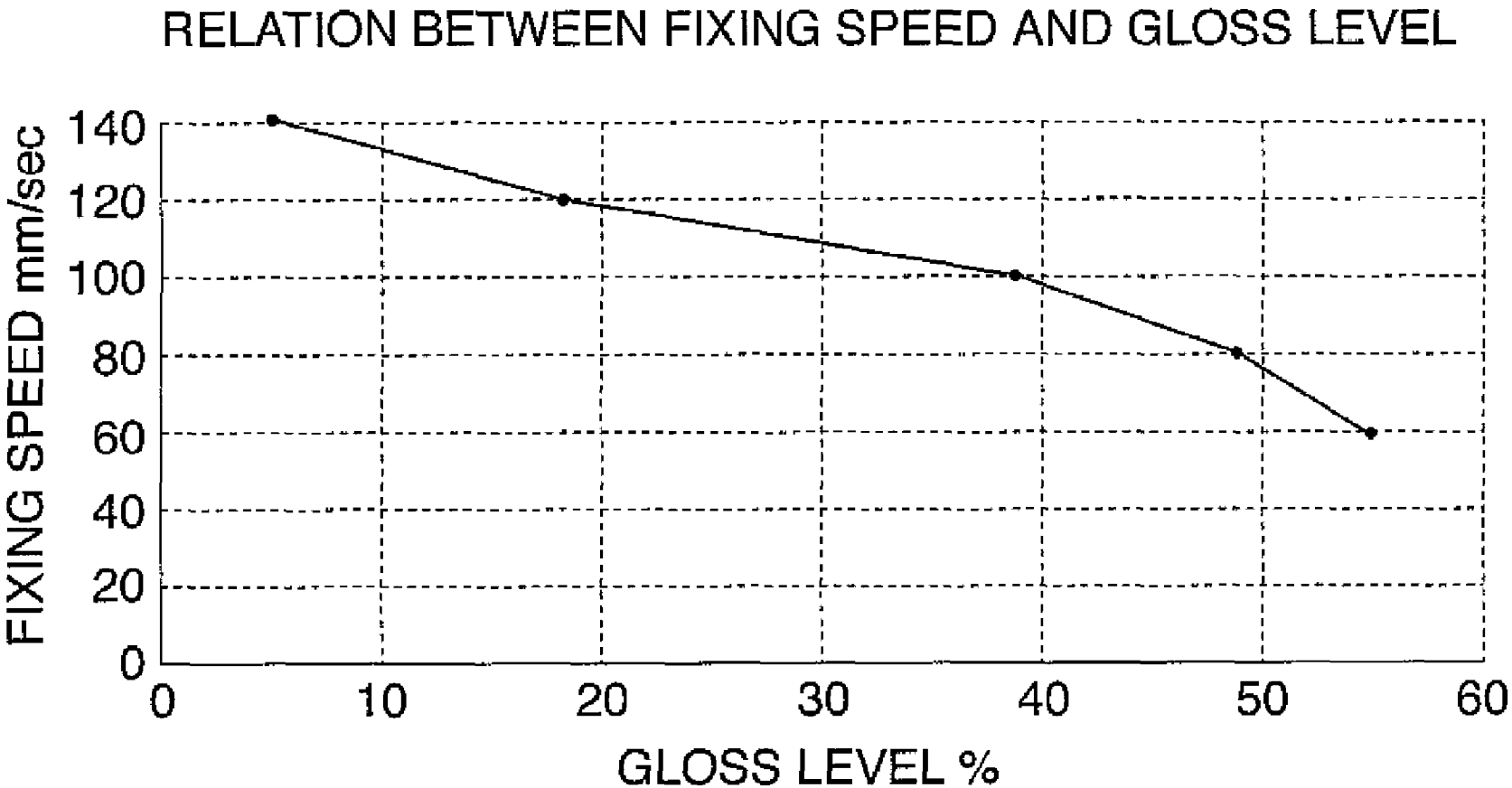
FIG. 18 is a view showing relation between a fixation speed and the gloss level of an output image.

FIG. 18 a view showing the relationship between a fixing speed and the gloss level of an output image.

In general, the higher the fixing speed is, the lower the gloss level of a toner-formed image is. A fixing speed herein refers to a speed at which a recording sheet passes between the fixing rollers 117. Thus, by controlling the fixing speed, an output image with a desired gloss level can be obtained.

Figure 19:
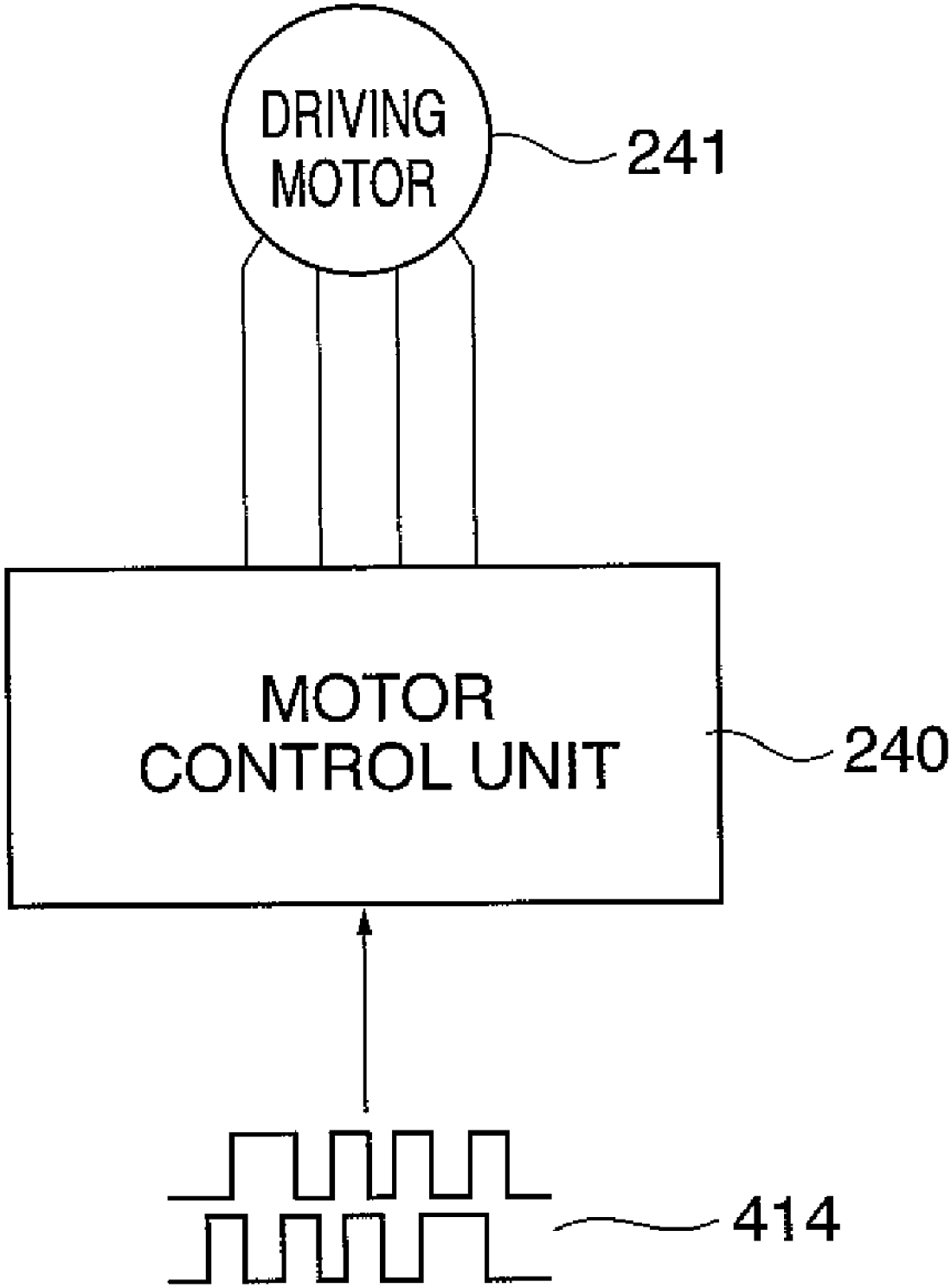
FIG. 19 is a view showing an arrangement to which a third gloss level control method is applied with a motor control unit controlling the fixation speed.

FIG. 19 is a view showing an arrangement to which the third gloss level control method is applied, where the motor control unit 240 controls the fixing speed.

The motor control unit 240 controls a rotation speed of motors that drive rollers for conveying a recording sheet and that are pertinent to the fixing speed among driving motors 241, based on the gloss level control signal 414. That is, the motor control unit 240 controls those motors to run at a predetermined target speed which is determined according to the gloss level control signal 414. The target speed is predetermined so as to provide an optimal gloss level that depends on an image type.

Next, referring to FIGS. 20 and 21, a screen for inputting an instruction on the gloss level that is displayed on the display unit of the operating unit 210 will be described.

Figure 20:
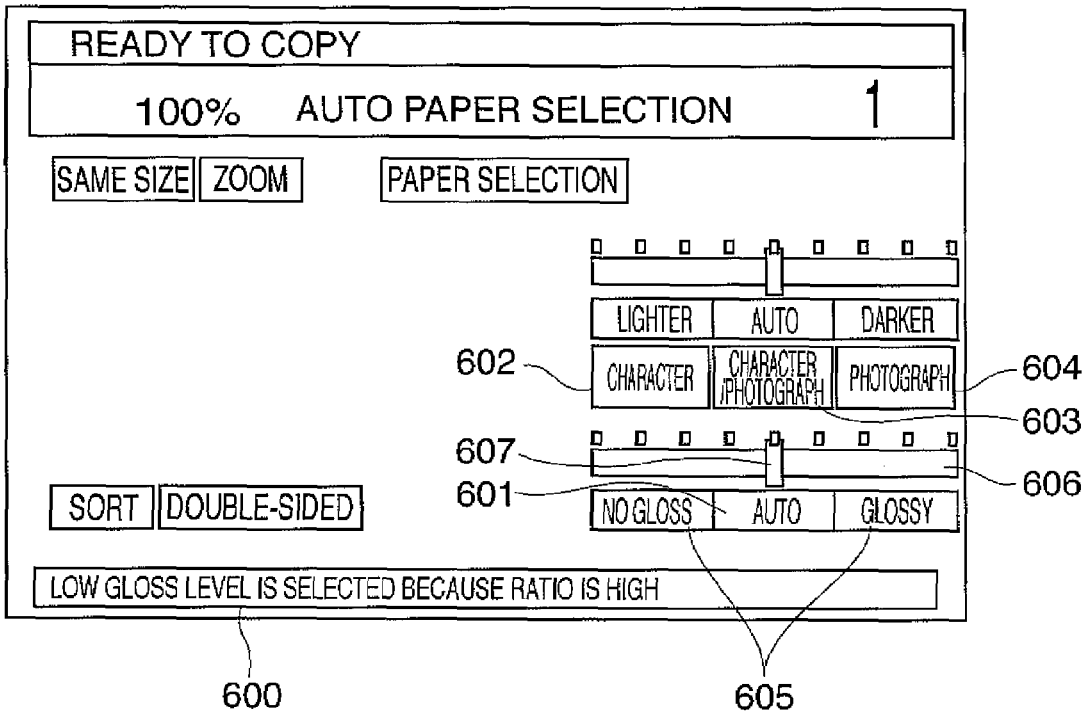
FIG. 20 is a view showing a first screen that is displayed on a display unit of an operating unit of the image forming apparatus.

FIG. 20 is a view showing a first screen that is displayed on the display unit 210*b* of the operating unit 210 of the image forming apparatus. On the first screen, operation keys for inputting a user's instruction on the gloss level are displayed.

A message display area 600 displays the gloss level of an image at the time of image output.

An auto-mode key 601 is a key for selecting automated gloss level control that calculates the composition ratio of image types in all pages and automatically decides one gloss level optimal for all the pages.

Image mode keys 602 to 604 are keys for selecting manual gloss level control that allows a user to specify a gloss level. In this embodiment, the user is allowed to set three types of gloss level mode, "Character", "Character/Photograph", and "Photograph". Specifically, when "Character" of the image mode key 602 is pressed, a low gloss level is set; when "Character/Photograph" of the image mode key 603 is pressed, a normal gloss level is set; and when "Photograph" of the image mode key 604 is pressed, a high gloss level is set.

A gloss level setting key 605 is a key for the user to freely set a gloss level. Although gloss levels that can be set with the auto-mode key 601 and the image mode keys 602 to 604 are gloss levels preset by the image forming apparatus, the user can arbitrarily adjust the preset gloss levels by operating the gloss level setting key 605.

A gloss level setting display unit 606 displays adjustment information of the gloss level by the gloss level setting key 605. When the gloss level setting key 605 is pressed, a pointer 607 moves either to left or right, so that the user can easily see a gloss level currently set.

When automatic gloss level control is implemented with operation of the auto-mode key 601, the message display area 600 indicates to the user with which of a low gloss level for character image, a normal gloss level for characters/photograph image, and a high gloss level for photograph image an image output bundle will be finally output. At a point the composition ratio of image types has been measured and a gloss level mode to be implemented has been decided, if a gloss level mode for character is selected, for example, the message display area 600 shows a message like "Low gloss level is selected because ratio of characters is high". In addition, as mentioned above, a gloss level currently set is indicated on the gloss level setting display unit 606.

After the auto-mode key 601 is operated to execute automatic gloss level control, if the user determines during image output that the gloss level set by the automatic gloss level mode is not what the user wants, the user can change the gloss level. The user can operate the image mode keys 602 to 604 or the gloss level setting key 605 with reference to the gloss level setting display unit 606, thereby switching to manual gloss level control, as described below with reference to FIG. 24.

Figure 21:
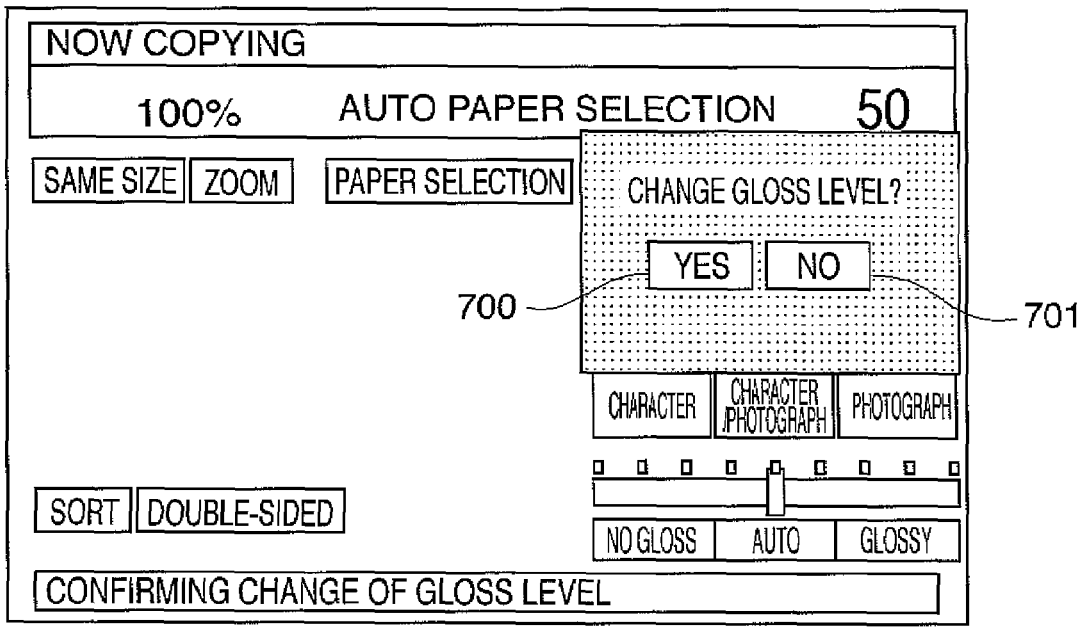
FIG. 21 is a view showing a second screen that is displayed on the display unit of the operating unit of the image forming apparatus.

If the image mode keys 602 to 604 or the gloss level setting key 605 are operated during image output, a screen for confirming whether to change gloss level during output appears on the display area 210*b* of the operating unit 210 as shown in FIG. 21. On this screen, if "Yes" key 700 is pressed, change of the gloss level is executed, and if "No" key 701 is pressed, change of the gloss level is canceled.

To allow a user to check if an image is output with a desired gloss level, "trial mode" may be provided, where the screen shown in FIG. 21 is displayed after one page of image is output so that the user can select from continuing the job with the current gloss level or changing the gloss level. If "No" key 701 is operated, the user may be allowed to change the gloss level to a desired one by operating the image mode keys 602 to 604 or the gloss level setting key 605.

Such gloss level control made by the gloss level control unit 250 will be described in detail with reference to FIGS. 22 and 23.

Figure 22:
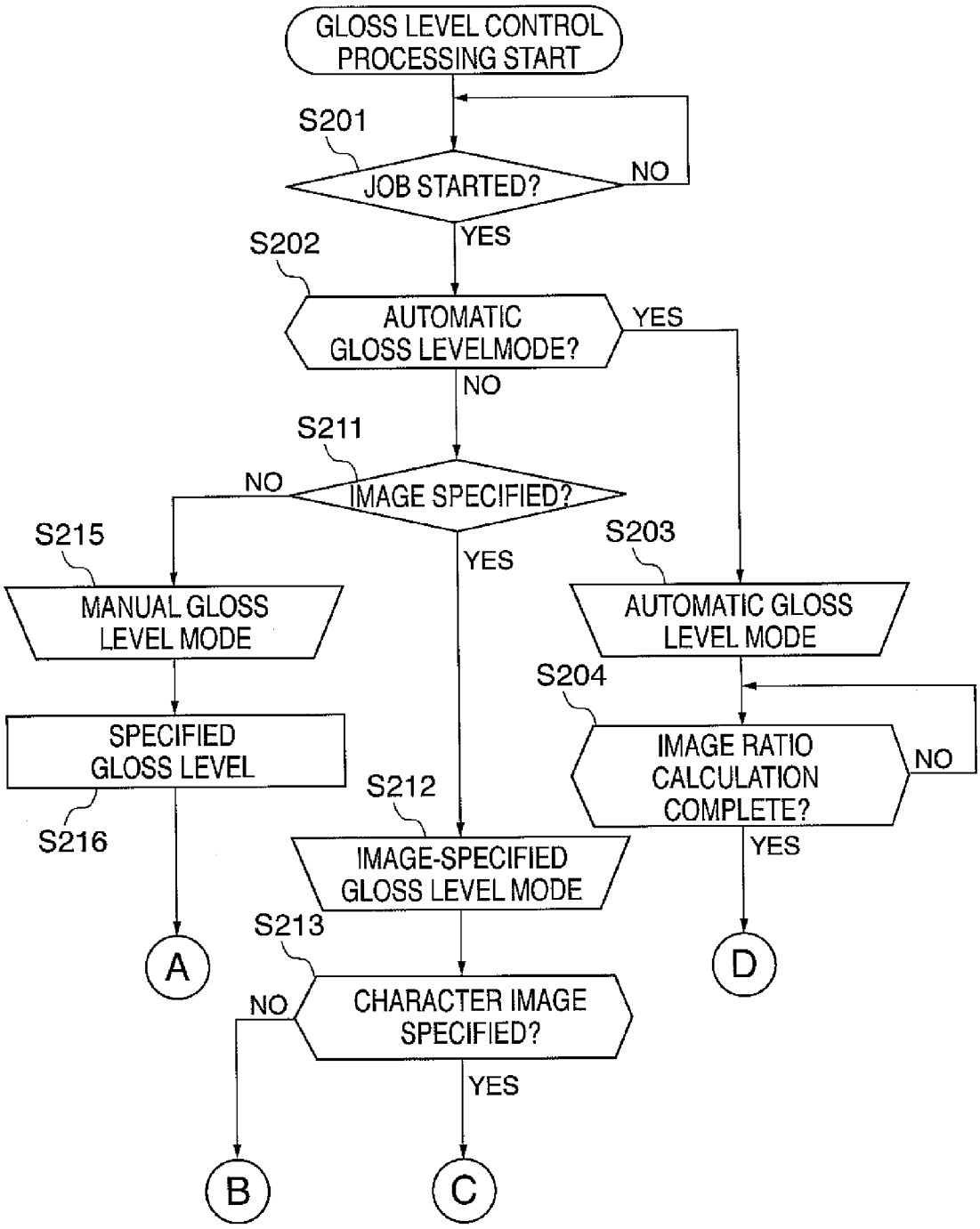
FIG. 22 is a flowchart showing the procedure of gloss level control processing implemented by a gloss level control unit.
Figure 23:
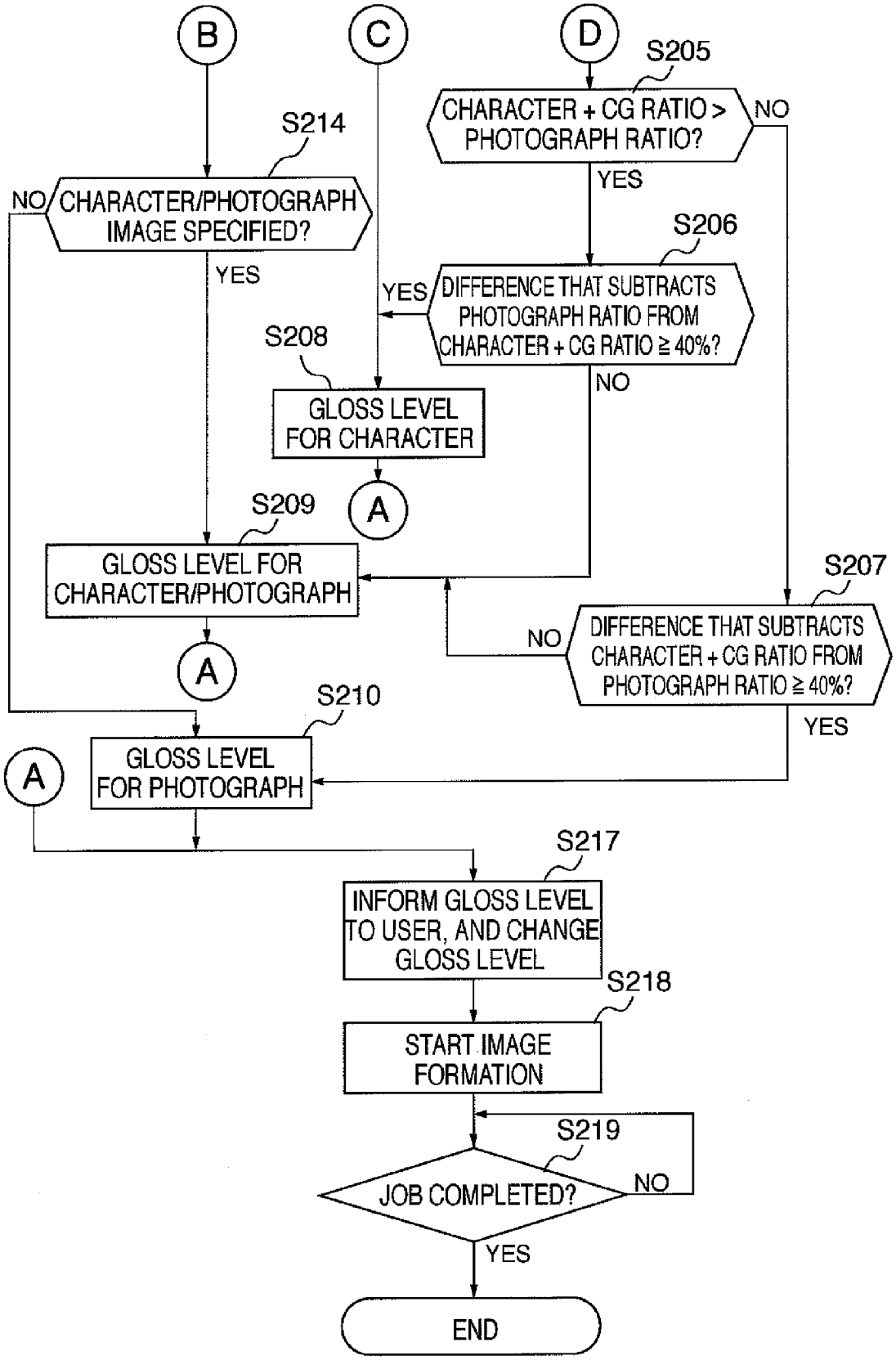
FIG. 23 is a flowchart showing the rest of the procedure shown in FIG. 22.

FIGS. 22 and 23 are flowcharts showing the procedure of gloss level control provided by the gloss level control unit 250. The gloss level control is performed by the CPU 200*a* executing the control program stored in the ROM 200*b*.

In a step S201, the procedure waits for an image forming job to be started, and when the image forming job is started, the procedure proceeds to a step S202.

In a step S202, it is determined whether the auto-mode key 601 of FIG. 20 has been operated to specify the automatic gloss level mode, and if the automatic gloss level mode is specified, the procedure proceeds to a step S203, otherwise, to a step S211.

In the step S203, the automatic gloss level mode (automatic gloss level control) is set, and the procedure proceeds to a step S204.

In the step S204, the image determination control unit 232 determines the types of images in all pages, and the image ratio calculation unit 233 calculates the composition ratio of image types. When the calculation of composition ratio of image types is complete, the procedure proceeds to a step S205.

In the step S205, based on the composition ratio calculated in the step S204, the composition ratio of character images plus that of CG images is compared with the composition ratio of photograph images, and if the former is larger than the latter, the procedure proceeds to a step S206. If the former is smaller, the procedure proceeds to a step S207.

In the step S206, it is determined whether the difference that subtracts the composition ratio of photograph images from the composition ratio of character images and that of CG images is 40% or more, and if the difference is 40% or more, the procedure proceeds to a step S208, where the low gloss level for character image is selected. However, if the difference is less than 40%, the procedure proceeds to a step S209, where the normal gloss level for character/photograph image is selected.

In the step S207, it is determined whether the difference that subtracts the composition ratio of character images and that of CG images from the composition ratio of photograph images is 40% or more, and if the difference is 40% or more, the procedure proceeds to a step S210, where the high gloss level for photograph is selected. If the difference is less than 40%, the procedure proceeds to the step S209, where the normal gloss level for character/photograph image is selected.

Although the difference of composition ratio of 40% is a threshold for varying a gloss level setting in the above description, the threshold is not limited to 40%.

In the step S211, it is determined whether an image type has been specified with the image mode keys 602 to 604 shown in FIG. 20, and if the image type is specified, the procedure proceeds to a step S212, otherwise, to a step S215.

In a step S212, an image-specified gloss mode for implementing gloss level control based on specification of an image type is set, and the procedure proceeds to a step S213.

In the step S213, it is determined whether character image has been specified, and if the character image is specified, the procedure proceeds to the step S208, where the gloss level for character image is selected. If the character image is not specified, however, the procedure proceeds to a step S214.

In the step S214, it is determined character/photograph image has been specified, and if the character/photograph image is specified, the procedure proceeds to the step S209, where the gloss level for character/photograph image is selected. If the character/photograph image is not specified, the procedure proceeds to the step S210, where the gloss level for photograph image is selected.

In the step S215, a manual gloss mode is set, and in the next step S216, a gloss level specified by the user is selected.

In a step S217, the gloss level control unit 250 outputs gloss level control signal 414 indicating the selected gloss level to the fixing control unit 220 or the motor control unit 240, and the gloss level is controlled by any one of the first to third gloss level control methods, that is, change of the gloss level is executed by the CPU 200*a*. In addition, a gloss level specified with the image mode keys 602 to 604 or a gloss level determined in the automatic gloss level mode is informed to the user in the message display area 600 of the operating unit 210.

In a step S218, an image forming operation is started with the selected gloss level, and when the operation is determined to be complete in a step S219, the gloss level control processing is terminated.

Consequently, an image output bundle that has a uniform and appropriate gloss level as a whole can be obtained.

Figure 24:
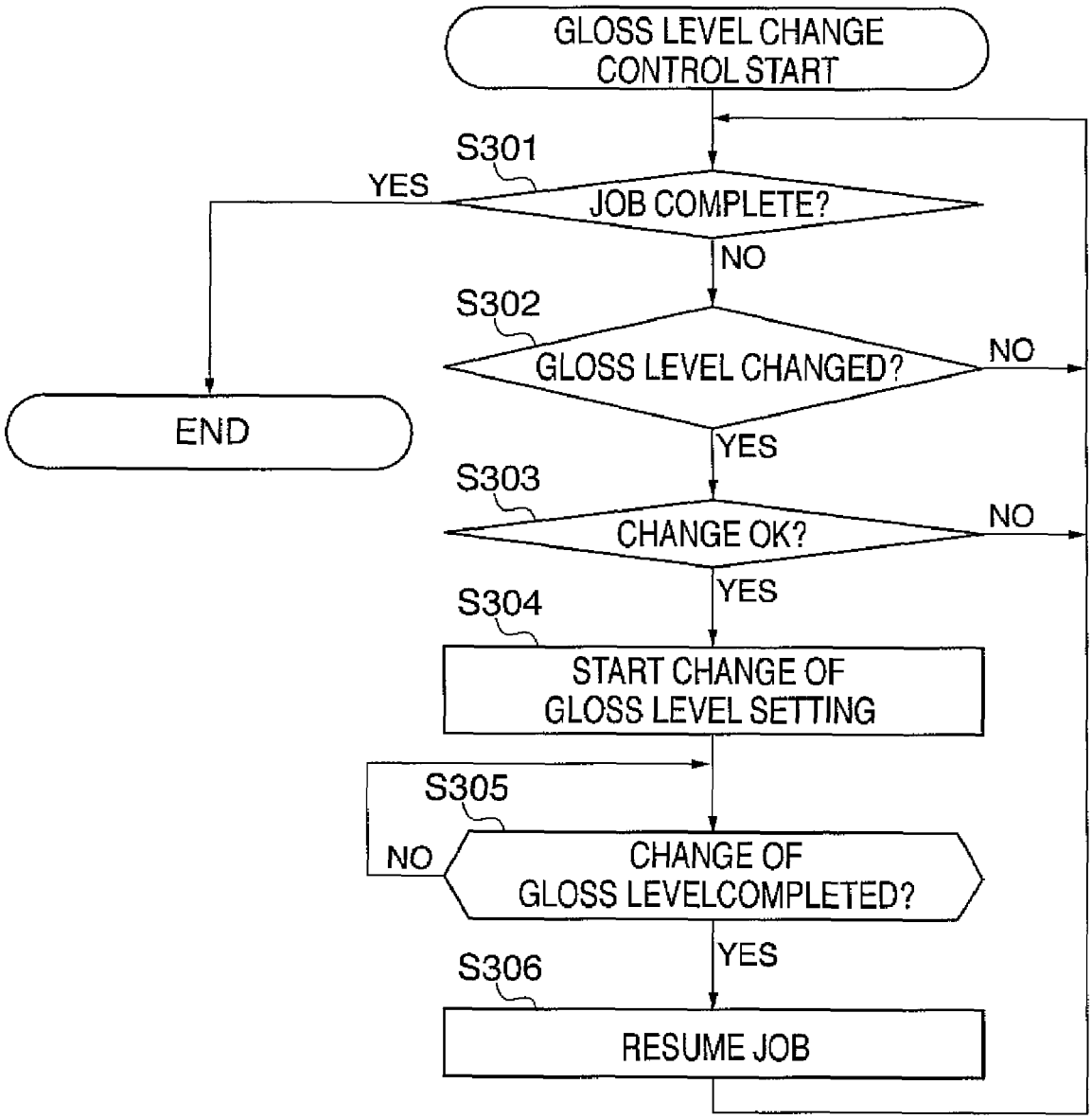
FIG. 24 is a flowchart showing the procedure of gloss level change control during an image output operation that is implemented by the gloss level control unit.

FIG. 24 is a flowchart showing the procedure of gloss level modification control during an image output operation, which is implemented by the gloss level control unit 250.

This gloss level change control is started when the steps S201 to S218 of the flowchart of FIGS. 22 and 23 have been executed and an end of a job is awaited in the step S219.

In a step S301, it is determined whether the job has completed (i.e., the image output operation has completed), and if the job has completed, this gloss level change control is completed. However, if the job has not completed, the procedure proceeds to a step S302.

In the step S302, change of the gloss level is monitored by the user, and if the gloss level is changed, the procedure proceeds to a step S303. However, if the gloss level is not changed, the procedure returns to the step S301.

In the step S303, since a setting of the gloss level has been changed, the changed gloss level setting is informed to the user, and as shown in FIG. 21, a screen for confirming whether the gloss level is changed is displayed on the display unit 210*b* of the operating unit 210. If "Yes" key 700 on the screen is pressed by the user and thus the change is approved, the procedure proceeds to a step S304. However, if "No" key 701 is pressed by the user and thus the change is not approved, the procedure returns to the step S301.

In the step S304, the image formation job is interrupted if necessary in changing the gloss level, and the gloss level is changed with any one of the first to third gloss level control methods described above. Timing at which the gloss level is changed is not specifically limited, the gloss level can be changed at the time of change of a page, for example.

In a step S305, it is determined change (switching) of the gloss level has been complete or not, and if it is complete, the procedure proceeds to a step S306.

In the step S306, the image formation job is resumed and the procedure returns to the step S301.

As described above, according to the present embodiment, an image output bundle having a uniform and appropriate gloss level as a whole can be easily obtained, whereby the usability can be enhanced. A gloss level decided by the automatic gloss level mode is displayed on the message display area 600 of the operation unit 210, and the usability therefore can be also enhanced by informing the user of output condition beforehand.

The ability to change the gloss level during an image forming operation allows a user to adjust gloss level at any time, thereby providing improved usability. When the gloss level is to be changed (switched), the screen for confirming whether the gloss level is changed is displayed on the display unit 210*b*, so that the user can notice an unintended change or a change halfway through an operation, which can provide enhanced usability.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of any of the embodiments described above, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, DVD-ROM, a DVD-RAM, a DVD-RW, a DVD+RW, a magnetic tape, a nonvolatile memory card, and a ROM. Alternatively, the program may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and function.

This application claims the benefit of Japanese Patent Application No. 2005-252344, filed Aug. 31, 2005, which is hereby incorporated by reference herein in its entirety.

What is claimed is:

1. An image forming apparatus that fixes a toner image on a plurality of recording materials, comprising:

an image type determination unit that determines an image type for each page of an original;

a composition ratio calculation unit that calculates a composition ratio of image types in all pages of the original based on the image type determined by said image type determination unit;

a gloss level decision unit that decides a gloss level of images to be formed based on the composition ratio of image types calculated by said composition ratio calculation unit; and an image forming unit that respectively forms images on a plurality of recording materials such that respective images formed on the plurality of recording materials have a uniform gloss level, based on the gloss level decided by said gloss level decision unit.

2. An image forming apparatus according to claim 1, wherein said image type determination unit determines the image type based on transition form of a signal indicative of image density in said each page.

3. An image forming apparatus according to claim 2, wherein said image type determination unit determines the image type based on a ratio of high-level duration of a pulse signal obtained by binarizing the signal indicative of image density in said each page to the entire time.

4. An image forming apparatus according to claim 1, wherein the image type determined by said image type determination unit includes at least character image and photograph image.

5. An image forming apparatus according to claim 1, wherein said image forming unit realizes the gloss level decided by said gloss level decision unit by adjusting at least one of fixing temperature, fixing pressure, and fixing speed of a fixing device that fixes the toner images applied to a recording material thereon.

6. An image forming apparatus according to claim 1, further comprising a reception unit that receives a gloss level specified by a user, and a manual image forming unit that forms images having the gloss level received by said reception unit.

7. An image forming apparatus according to claim 1, further comprising a change instruction receiving unit that receives an instruction to change the gloss level during image formation by said image forming unit, wherein said image forming unit forms images having the changed gloss level in accordance with the instruction to change the gloss level received by said change instruction receiving unit.

8. An image forming apparatus according to claim 7, further comprising a gloss level change confirmation unit that confirms whether a user approves forming images having the changed gloss level according to the instruction to change the gloss level received by said change instruction receiving unit, wherein said image forming unit forms the images when an instruction indicative of approval of forming images having the changed gloss level is input from the user as a result of confirmation by said gloss level change confirmation unit.

9. An image forming apparatus according to claim 1, further comprising a gloss level notification unit that notifies the gloss level when the images are formed by said image forming unit.

10. A gloss level control method applied to an image forming apparatus that fixes a toner image on a plurality of recording material, comprising:

an image type determining step of determining an image type in each page of an original;

a composition ratio calculating step of calculating a composition ratio of image types in all pages of the original based on the image type determined in said image type determining step;

a gloss level decision step of deciding a gloss level of images to be formed based on the composition ratio of image types calculated in said composition ratio calculating step; and an image forming step of causing an image forming unit to respectively form images on a plurality of recording materials such that respective images formed on the plurality of recording materials have a uniform gloss level, based on the gloss level decided in said gloss level deciding step.

11. A gloss level control method according to claim 10, further comprising a receiving step of receiving a gloss level specified by a user, and a manual image forming step of causing the image forming unit to form images having a gloss level received in said receiving step.

12. A gloss level control method according to claim 10, further comprising a change instruction receiving step of receiving an instruction to change the gloss level during image formation in said image forming step, wherein said image forming step causes the image forming unit to form images having a changed gloss level in accordance with the instruction to change the gloss level received in said change instruction receiving step.

13. A gloss level control method according to claim 12, further comprising a gloss level change conformation step of confirming whether a user approves forming images having the changed gloss level by said image forming unit in accordance with the instruction to change the gloss level received in said change instruction receiving step, wherein said image forming step causes said image forming unit to form the images when an instruction indicative of approval of forming images having the changed gloss level is input from the user as a result of confirmation in said gloss level change confirmation step.

14. A gloss level control method according to claim 10, further comprising a gloss level notification step of notifying the gloss level when an image is formed in said image forming step.

* * * * *